US009000952B1

(12) United States Patent
Vanderkamp et al.

(10) Patent No.: US 9,000,952 B1
(45) Date of Patent: Apr. 7, 2015

(54) AIRPORT SURFACE INFORMATION PRESENTATION METHODS FOR THE PILOT INCLUDING TAXI INFORMATION

(71) Applicants: Travis S. Vanderkamp, Marion, IA (US); Christopher A. Scherer, Cedar Rapids, IA (US); Victor E. Villagomez, Cedar Rapids, IA (US); Felix B. Turcios, Cedar Rapids, IA (US)

(72) Inventors: Travis S. Vanderkamp, Marion, IA (US); Christopher A. Scherer, Cedar Rapids, IA (US); Victor E. Villagomez, Cedar Rapids, IA (US); Felix B. Turcios, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 80 days.

(21) Appl. No.: 13/926,411

(22) Filed: Jun. 25, 2013

(51) Int. Cl.
*G08B 21/00* (2006.01)
*G08G 5/00* (2006.01)

(52) U.S. Cl.
CPC ..... *G08G 5/0065* (2013.01)

(58) Field of Classification Search
USPC ..... 340/945, 947–952, 971, 972, 980; 701/3, 120
See application file for complete search history.

(56) References Cited

U.S. PATENT DOCUMENTS 7,587,278 B2 * 9/2009 Poe et al. ..... 701/301

* cited by examiner

*Primary Examiner* — Jeffrey Hofsass
(74) *Attorney, Agent, or Firm* — Angel N. Gerdzhikov; Donna P. Suchy; Daniel M. Barbieri

(57) ABSTRACT

Present novel and non-trivial methods for presenting taxi information to a pilot are disclosed. Each method may generate an image data set from taxi information data and navigation reference and object data. A first image data set may be representative of an image in which one or more first location highlighter(s) highlighting the location(s) of one or more raised surface feature(s) appears within an egocentric or exocentric three-dimensional representation of a scene located outside the aircraft. A second image data set may be representative of an image in which one or more unconventional surface feature(s) highlighting the location(s) of one or more raised surface feature(s) appears within an egocentric or exocentric three-dimensional representation of a scene located outside the aircraft. A third image data set may be representative of an image in which one or more unconventional surface feature(s) appears within an airport surface map.

20 Claims, 38 Drawing Sheets

AIRPORT SURFACE INFORMATION PRESENTATION METHODS FOR THE PILOT INCLUDING TAXI INFORMATION

BACKGROUND OF THE INVENTION

1. Field of the Invention

This invention pertains generally to the field of aircraft displays that depict taxiway surface information.

2. Description of the Related Art

A great deal of attention in the aviation industry has been paid to the avoidance of runway incursions. A runway incursion is an incident at an airport which adversely affects runway safety. Runway incursions are the most noticeable form of taxi navigation errors. Increased scrutiny by regulatory authorities has only heightened the awareness of the safety issues related to runway incursions. Taxi navigation errors cause many runway incursions and present potential collision hazards.

Inventors have addressed the issue of runway incursion. For example, Carrico et al addresses the issue of runway incursion in U.S. patent application Ser. No. 13/236,676 entitled "System, Apparatus, and Method for Generating Airport Surface Incursion Alert." In another example, Corcoran III addresses the issue of runway incursion in U.S. Pat. No. 6,606,563 entitled "Incursion Alerting System." In Corcoran III, a system is presented for alerting the occupant of a vehicle that the vehicle is approaching a zone of awareness, where the zone of awareness surrounds a runway and is based upon a reference such as a line or line segment that defines a runway centerline. When the vehicle is within a predetermined value of the zone of awareness, an alert is provided to the occupant. That is, a processor calculates the difference between the zone of awareness and the aircraft and initiates the alerting device if the distance is within predetermined parameters. The processor may also take into account the direction of travel and/or velocity when initiating the alert to adjust predetermined parameters by, for instance, increasing a fixed distance at which the alert is initiated if the vehicle is approaching the zone of awareness. Alternatively, the processor may adjust values corresponding to the location of the vehicle, location of the reference upon which the zone of awareness is based, or the distance between the vehicle location and reference location, according to the velocity, direction of travel, or both.

In another example, Roe et al discusses an on-ground Runway Awareness and Advisory System ("RAAS") in U.S. Pat. No. 7,587,278 entitled "Ground Operations and Advanced Runway Awareness and Advisory System." In Roe, the RAAS enhances situational awareness during taxiing by providing advisories to the pilot. The RAAS algorithm determines whether the aircraft will cross a runway or whether the aircraft is on the runway and provides applicable advisories. For landing and on-ground aircraft, the RAAS constructs an advisory annunciation envelope or bounding box from which situational awareness annunciations are announced. An Aural/Visual Advisory Processing function generates an advisory when a runway encounter is triggered when an aircraft enters the envelope surrounding the runway that could be augmented as a function of ground speed.

In another example, Krenz et al discusses a system for providing taxi navigation information to a pilot of an aircraft in U.S. Pat. No. 7,974,773 entitled "Methods and Devices of an Aircraft Taxi Navigation System." In Krenz, taxi navigation symbology representative of airport signs comprised of graphical objects are presented to the pilot in an egocentric manner or a "pilot's eye" view and not a "bird's eye" view such as reading a roadmap. There were several novel aspects therein including the use of ICAO taxiway and runway signage symbols depicted in an egocentric format on the primary cockpit indicator, the placement of symbologies of runway signage to indicate upcoming left and right turns and current airport surface, the use of distance indications adjacent to the symbologies, and display of a plurality of turns to the left and to the right.

Despite many improvements, situational awareness of the runway environment still remains a significant safety issue.

BRIEF SUMMARY OF THE INVENTION

The embodiments disclosed herein present novel and non-trivial methods for providing taxi information to a pilot of an aircraft. By improving the pilot's situational awareness with the embodiments disclosed herein, a reduction in the number of runway incursions should be realized.

As embodied herein, three methods are disclosed for providing taxi information to a pilot of an aircraft, where such method could be performed by the processor. When properly configured, the processor of each method may receive taxi information data representative of at least the current position of an aircraft, retrieve navigation reference and object data representative of at least one surface feature, generate an image data set as a function of the taxi information data and the navigation reference and object data, and provide the image data set to a display system.

In a first method, the image data set could be representative of an image in which one or more first location highlighters highlight the location(s) of one or more raised surface features that appear within three-dimensional representation of a scene located outside the aircraft. Each first raised surface feature may be depicted above the location of one first surface feature and comprised of a raised hold-short line.

In a second method, the image data set could be representative of an image in which one or more unconventional surface feature(s) that appear within three-dimensional representation of a scene located outside the aircraft. Each unconventional surface feature may be depicted at the location of one conventional surface feature and comprised of one unconventional surface hold-short indicator.

In a third method, the image data set could be representative of an image in which one or more unconventional surface feature(s) appear within an airport surface map. Each unconventional surface feature may be depicted at the location of one conventional surface feature and comprised of one unconventional surface hold-short indicator.

DETAILED DESCRIPTION OF THE INVENTION

In the following description, several specific details are presented to provide a thorough understanding of embodiments of the invention. One skilled in the relevant art will recognize, however, that the invention can be practiced without one or more of the specific details, or in combination with other components, etc. In other instances, well-known implementations or operations are not shown or described in detail to avoid obscuring aspects of various embodiments of the invention.

Figure 1:
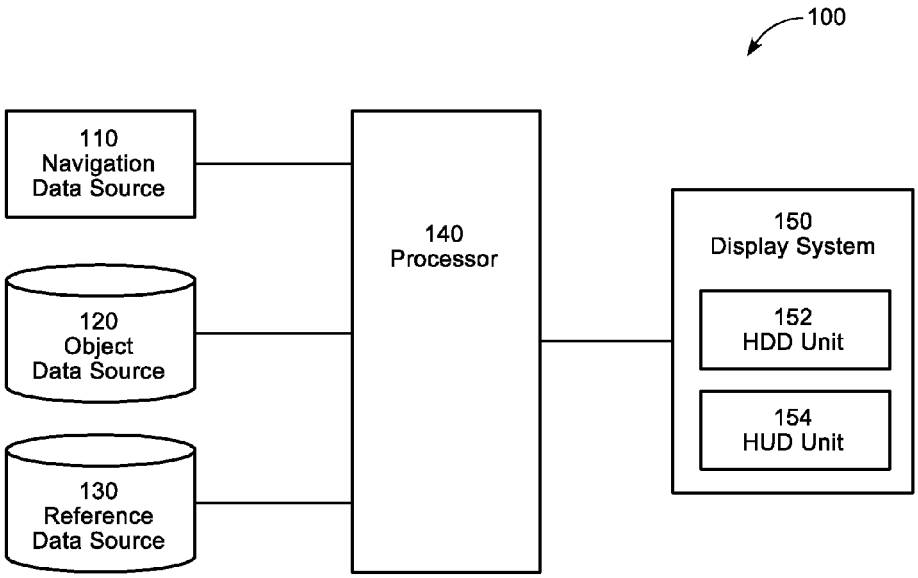
FIG. 1 depicts a block diagram of a system for presenting taxi information on a display unit.

FIG. 1 depicts a block diagram of a taxi information presentation system 100 suitable for implementation of the techniques described herein. The highlighting presentation system 100 of an embodiment of FIG. 1 includes a navigation data source 110, an object data source 120, a reference data source 130, a processor 140, and a display system 150.

In an embodiment of FIG. 1, the navigation data source 110 could be comprised of a system or systems that provide navigation data information in an aircraft. As embodied herein, the navigation data could include taxi data representative of taxi information such as a route specified in a taxi clearance. For the purposes of the disclosures discussed herein, an aircraft could mean any vehicle which is able to fly through the air or atmosphere including, but not limited to, lighter than air vehicles and heavier than air vehicles, wherein the latter may include fixed-wing and rotary-wing vehicles.

The navigation data source 110 may include, but is not limited to, an air/data system, an attitude heading reference system, an inertial guidance system (or inertial reference system), and a global navigation satellite system (or satellite navigation system), all of which are known to those skilled in the art. The navigation data source 110 could provide navigation data including, but not limited to, geographic position 112, altitude 114, heading 116, and attitude 118. As embodied herein, aircraft position includes geographic position (e.g., latitude and longitude coordinates), altitude, or both. As embodied herein, aircraft orientation may include pitch, roll, and/or yaw information related to the attitude of the aircraft. The navigation data source 110 could provide the navigation data to the processor 140 for subsequent processing as discussed herein.

As embodied herein, the navigation data source 110 could also include a flight management system ("FMS") which could perform a variety of functions performed to help the crew in the management of the flight; these functions are known to those skilled in the art. These functions could include maintaining the current location of the aircraft and/or receiving and storing taxi route information comprised of one defined surface or a series of defined surfaces. The FMS may also allow for the modification of the taxi data.

In an embodiment of FIG. 1, the object data source 120 could be comprised one or more sources of object data that could be comprised of terrain data and/or surface feature data. The object data source 120 could be comprised of, but is not limited to, a terrain database configured to store terrain data contained in digital elevation models ("DEM"). Generally, the terrain data of a DEM are stored as grids, and each grid represents an area of terrain and is commonly referred to as a terrain cell. The object data source 120 could be a database configured to store data representative of surface features such as, but not limited to, obstacles, buildings, lakes and rivers, and paved or unpaved surfaces. The object data source 120 is a data source known to those skilled in the art.

It should be noted that data contained in any database discussed herein may be stored in a digital memory storage device or computer-readable media including, but not limited to, RAM, ROM, CD, DVD, hard disk drive, diskette, solid-state memory, PCMCIA or PC Card, secure digital cards, and compact flash cards. Data contained in such databases could be loaded while an aircraft is on the ground or in flight. Data contained in such databases could be provided manually or automatically through an aircraft system capable of receiving and/or providing such manual or automated data. Any database used in the embodiments disclosed herein may be a stand-alone database or a combination of databases.

In an embodiment of FIG. 1, the reference data source 130 could be comprised of any source of reference point data. The reference data source 130 could be comprised of a flight navigation database that may be part of the FMS and/or a taxi navigation database. The flight navigation database may contain records which provide reference data such as, but not limited to, surface data for taxiways and runways.

It should be noted that there could be an overlap of data between the object data source 120 and the reference data source 130. As embodied herein, a manufacturer and/or end-user may use the data from either source when such overlap occurs.

The reference data source 130 could be comprised of a taxi navigation database for storing airport data representative of, in part, airport surfaces and airport visual aids. In addition, the reference data source 130 could be a database that could store location data representative of a plurality of surface locations that define at least one feature such as, but not limited to, surface edges and/or boundaries, surface centerlines, and/or surface hold-short lines. The taxi navigation database could comprise an aerodrome mapping database ("AMDB") as described in the following document published by RTCA, Incorporated: RTCA DO-272A entitled "User Requirements for Aerodrome Mapping Information." DO-272A provides for aerodrome surface mapping requirements for aeronautical uses particularly on-board aircraft. Those skilled in the art appreciate that these standards may be changed with future amendments or revisions, that additional content may be incorporated in future revisions, and/or that other standards related to the subject matter may be adopted. The embodiments disclosed herein are flexible enough to include such future changes and/or adoptions without affecting the content and/or structure of an AMDB. As embodied herein, the reference data source 130 could provide reference point data to the processor 140 for subsequent processing as discussed herein.

In an embodiment of FIG. 1, the processor 140 may be any electronic data processing unit which executes software or computer instruction code that could be stored, permanently or temporarily, in a digital memory storage device or computer-readable media (not depicted herein) including, but not limited to, RAM, ROM, CD, DVD, hard disk drive, diskette, solid-state memory, PCMCIA or PC Card, secure digital cards, and compact flash cards. The processor 140 may be driven by the execution of software or computer instruction code containing algorithms developed for the specific functions embodied herein. The processor 140 may be an application-specific integrated circuit (ASIC) customized for the embodiments disclosed herein. Common examples of electronic data processing units are microprocessors, Digital Signal Processors (DSPs), Programmable Logic Devices (PLDs), Programmable Gate Arrays (PGAs), and signal generators; however, for the embodiments herein, the term "processor" is not limited to such processing units and its meaning is not intended to be construed narrowly. For instance, the processor could also consist of more than one electronic data processing unit. As embodied herein, the processor 140 could be a processor(s) used by or in conjunction with any other system of the aircraft including, but not limited to, the navigation data source 110, the object data source 120, the reference data source 130, the display system 150, or any combination thereof.

The processor 140 may be programmed or configured to receive as input data representative of information obtained from various systems and/or sources including, but not limited to, the navigation data source 110, the object data source 120, and the reference data source 130. As embodied herein, the terms "programmed" and "configured" are synonymous. The processor 140 may be electronically coupled to systems and/or sources to facilitate the receipt of input data. As embodied herein, operatively coupled may be considered as interchangeable with electronically coupled. It is not necessary that a direct connection be made; instead, such receipt of input data and the providing of output data could be provided through a data bus or through a wireless network. The processor 140 may be programmed or configured to execute one or both of the methods discussed in detail below. The processor 140 may be programmed or configured to provide output data to various systems and/or units including, but not limited to, the display system 150.

In the embodiment of FIG. 1, the display system 150 may receive image data from a processor 140. The display system 150 could include any unit that provides symbology of tactical flight information including, but not limited to, a Head-Down Display ("HDD") unit 152 and/or a Head-Up Display ("HUD") unit 154. As embodied herein, the disclosures may be applied to one or more portable devices including, but not limited to, laptop computer, smartphone, and/or tablets which employ a display unit.

The HDD unit 152 may present tactical information to the pilot or flight crew—information relevant to the instant or immediate control of the aircraft, whether the aircraft is in flight or on the ground. The HDD unit 152 is typically a unit mounted to an aircraft's flight instrument panel located in front of a pilot and below the windshield and the pilot's field of vision. The HDD unit 152 displays the same information found on a primary flight display ("PFD"), such as "basic T" information (i.e., airspeed, attitude, altitude, and heading). Although it provides the same information as that of a PFD, the HDD unit 152 may also display a plurality of indications or information including, but not limited to, selected magnetic heading, actual magnetic track, selected airspeeds, selected altitudes, altitude barometric correction setting, vertical speed displays, flight path angle and drift angles, flight director commands, limiting and operational speeds, mach number, radio altitude and decision height, final approach trajectory deviations, and marker indications. The HDD unit 152 is designed to provide flexible configurations which may be tailored to the desired configuration specified by a buyer or user of the aircraft. In an embodiment of FIG. 1, locations above surface features may be depicted in an image on the HDD unit 152 using location highlighters as disclosed herein.

The HUD unit 154 provides tactical information to the pilot or flight crew in the pilot's forward field of view through the windshield, eliminating transitions between head-down to head-up flying. Similar to the HDD unit 152, the HUD unit 154 may be tailored to the desired configuration specified by a buyer or user of the aircraft. As embodied herein, the HDD unit 152, the HUD unit 154, or any display unit could receive an image data set from the processor 140 for subsequent presentation.

Figure 2:
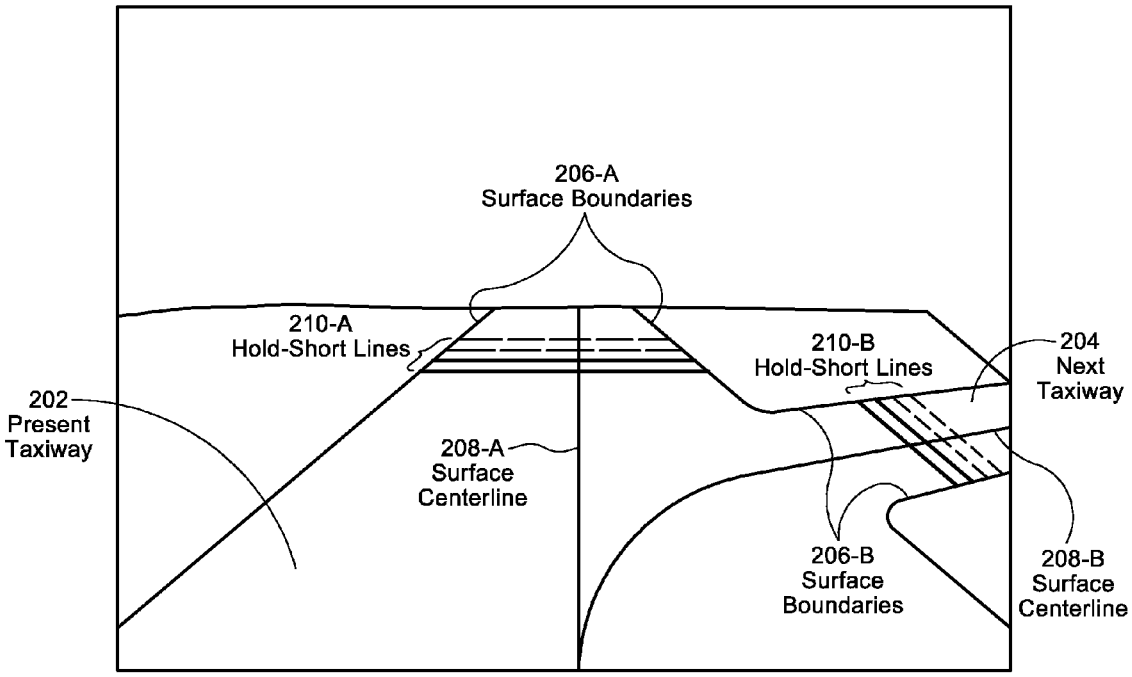
FIG. 2 illustrates an image of two intersecting taxiways.

Referring to FIG. 2, two intersecting taxiways are depicted on the HDD unit 152, a present taxiway 202 and a next taxiway 204. Each taxiway is comprised of surface boundaries 206, surface centerlines 208, and surface hold-short lines 210-A and 210-B. For the purpose of illustration and not of limitation, the following discussion will be drawn to the references shown in FIG. 2.

The advantages and benefits of the embodiments discussed herein may be illustrated by showing example depictions of location highlighters used to highlight the locations of surface hold-short lines that may or may not be stated in the taxi instructions represented in the taxi data; the use of location highlighters to present taxi instructions by highlighting location of raised surface boundaries, raised surface edges, and/or raised centerlines was disclosed by Scherer et al in U.S. patent application Ser. No. 13/567,663 entitled "Taxi Information Presentation System, Device, and Method" ("the Scherer reference"), a reference incorporated herein in its entirety. In FIGS. 3A through 11F, examples are provided of how surface hold-short lines could be presented on the HDD unit 152 through the use of location highlighters. Locations above the hold-short lines of a surface(s) (or "raised" hold-short lines) may be depicted by a set of three-dimensional location highlighters located above from the surface, where each location highlighter may be comprised with a proximal end (i.e., the end nearest the surface), a distal end, and a body in between both ends that extends upwardly towards the distal end. As embodied herein, raised hold-short lines may be presented with various levels of transparency. Although the following discussion will be drawn surface hold-short lines presented on the HDD 152, the embodiments disclosed herein may be presented on the HUD unit 154.

Figure 3A:
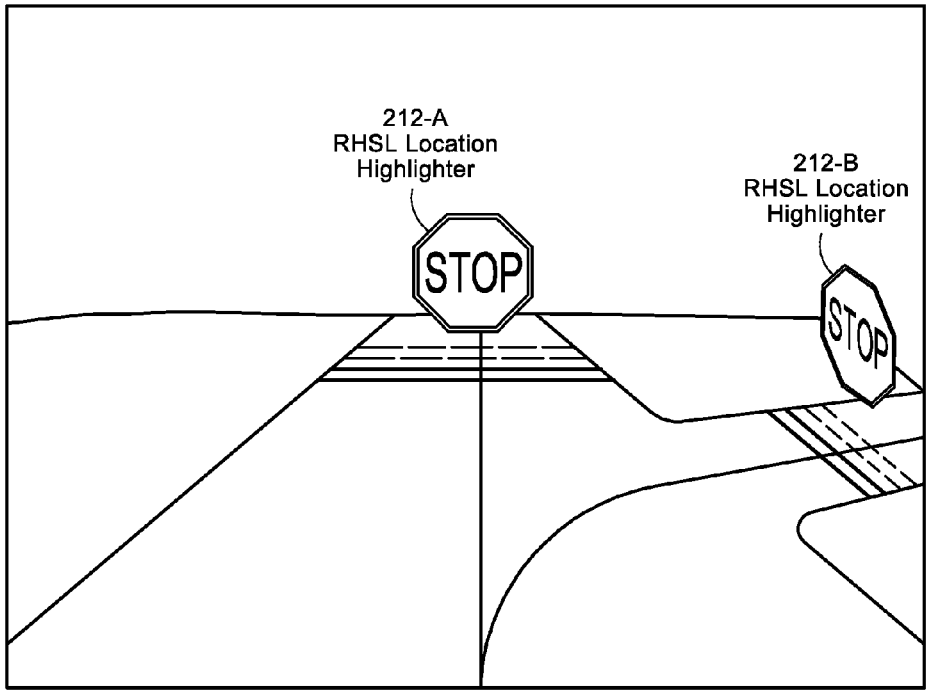
FIG. 3A depicts an image presenting a plurality of raised hold-short line ("RHSL") location highlighters.
Figure 3B:
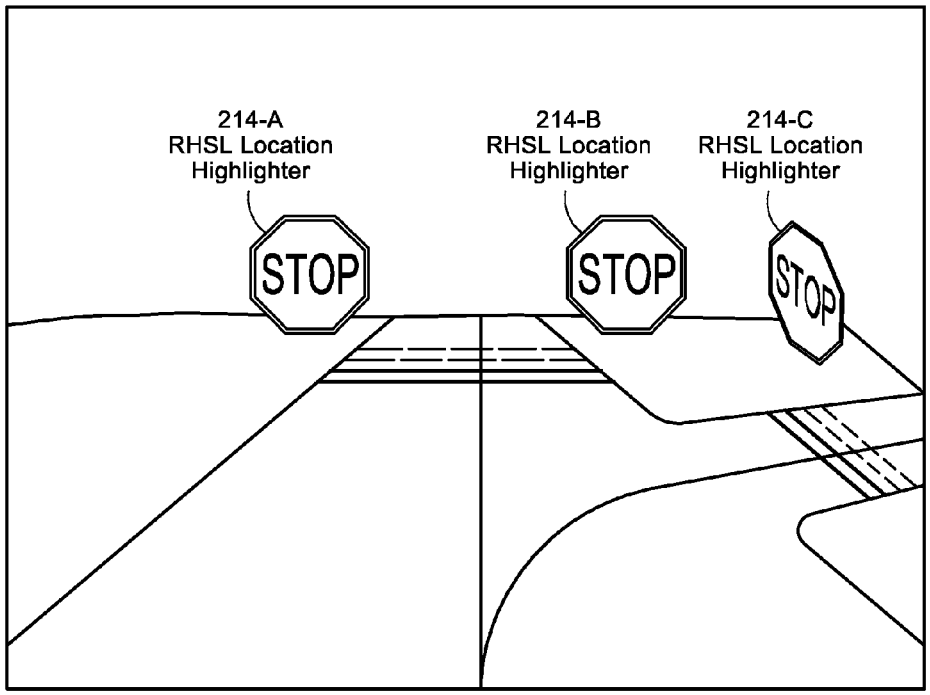
FIG. 3B depicts an image presenting a plurality of RHSL location highlighters.

Referring to FIGS. 3A and 3B, it will be assumed that taxi data has not been provided to the processor 140. As illustrated in FIG. 3A, the locations of raised hold-short lines 212-A and 212-B appearing above the surface hold-short lines 210-A and 210-B located in the scene outside the aircraft are illustrated as stop signs (i.e., barriers) highlighting the locations of raised hold-short lines (shown as "RHSL" in the drawings); for display units configured to display a plurality of colors, the stop sign could be presented in red and/or without text. The raised hold-short lines 212-A and 212-B could convey to the pilot that he or she will "crash into" or "pass through" a stop sign as he or she continues to taxi.

Although the following discussion of raised hold-short lines will be drawn to those appearing above surface hold-short lines that are visible, the hold-short lines may be replaced by raised hold-short lines. If so, then the raised hold-short lines may appear above the locations of surface hold-short lines.

Although the raised hold-short line 212-A appears in between surface boundaries 206-A and 206-B and the raised hold-short line 212-B appears in between surface boundaries 208-A and 208-B, one or more of them may appear outside of them. As illustrated in FIG. 3B, the locations of raised hold-short lines 214-A and 214-B appear above and to the side of surface hold-short lines 210-A, and the location of a raised hold-short line 214-C appears above and to the side of the surface hold-short lines 210-B. The raised hold-short lines 214-A through 214-C could convey to the pilot that he or she will "pass by" a stop sign(s) as he or she continues to taxi. It should be noted that, although the following examples will be drawn to raised hold-short lines appearing in between surface boundaries 206-A and 206-B and surface boundaries 208-A and 208-B, the embodiments disclosed herein are not limited to such configuration.

Figure 4A:
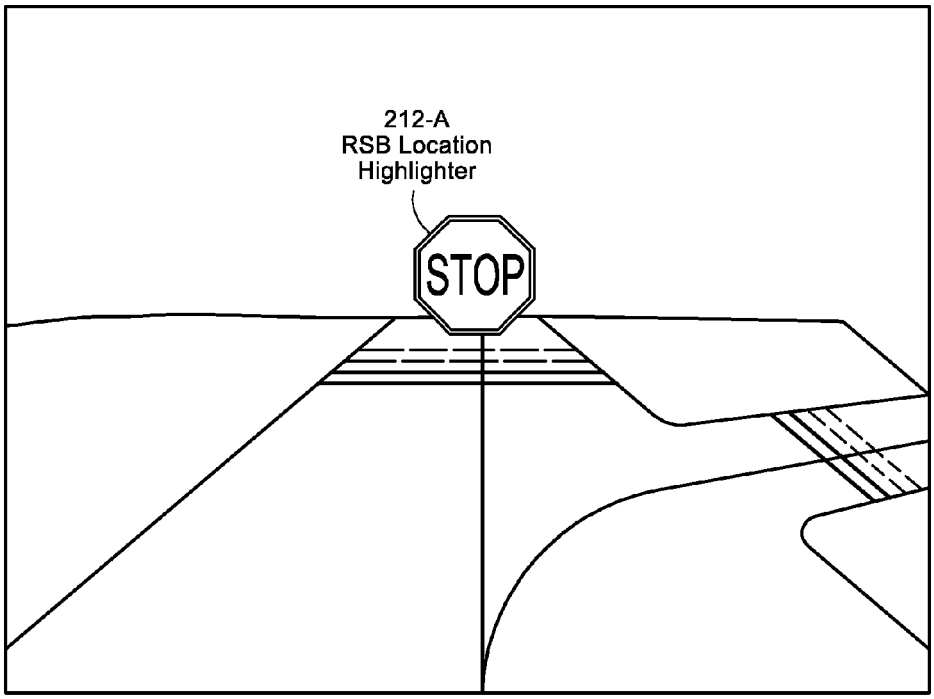
FIG. 4A depicts an image presenting a single RHSL location highlighter.
Figure 4B:
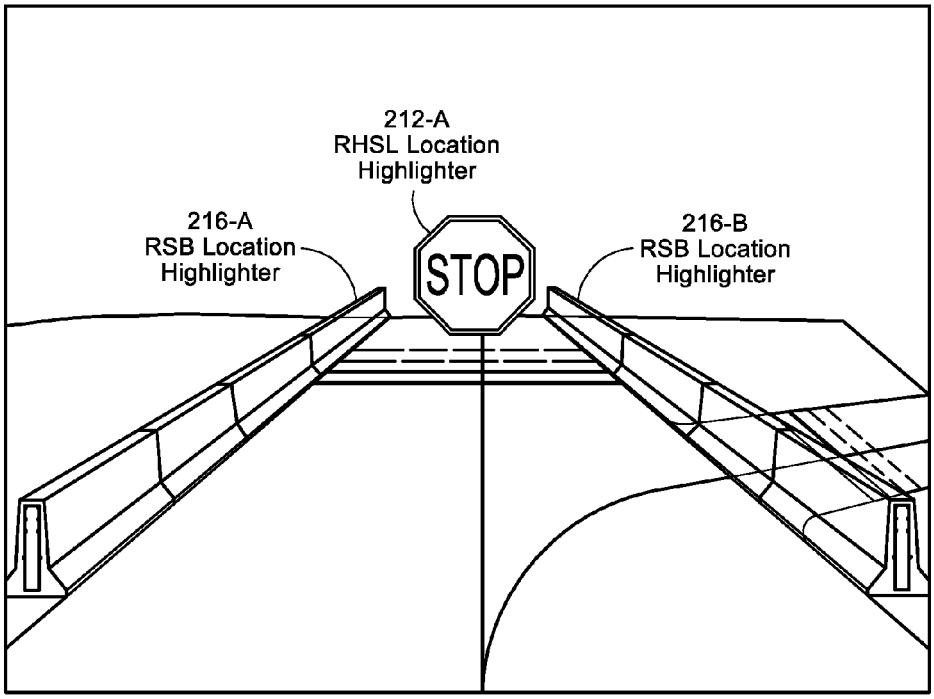
FIG. 4B depicts an image presenting a single RHSL location highlighter and a plurality of raised surface boundary ("RSB") location highlighters.
Figure 4C:
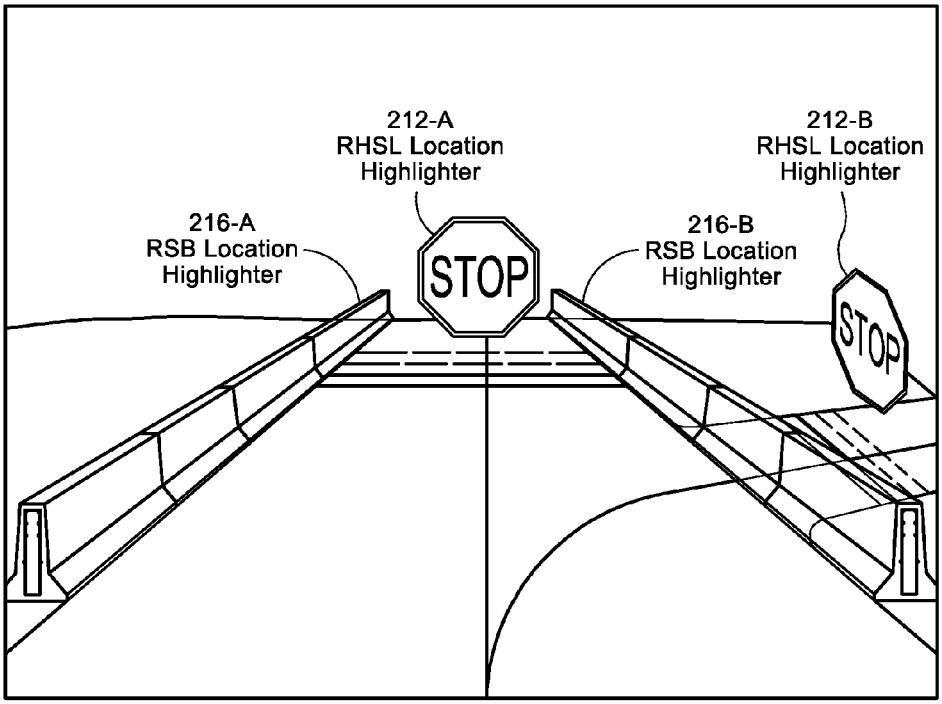
FIG. 4C depicts an image presenting a plurality of RHSL location highlighters and a plurality of RSB location highlighters.

Referring to FIGS. 4A through 4C, it will be assumed that taxi data has been provided to the processor 140 and that the taxi clearance includes the present taxiway 202 and a "hold-short" instruction (or equivalent instruction) corresponding to the surface hold-short lines 210-A; that is, the taxiway is a designated surface route. As illustrated in FIG. 4A, the raised hold-short line 212-A appears above surface hold-short lines 210-A corresponding to the designated surface route. As illustrated in FIG. 4B, the raised hold-short line 212-A of FIG. 4A appears with the locations of raised surface boundaries 216-A and 216-B (shown as "RSB" in the drawings) corresponding to the designated surface route of the taxi clearance that is illustrated by a series or sequence of "jersey barriers" as disclosed in the Scherer reference. As illustrated in FIG. 4C, the raised hold-short lines 212-A and 212-B of FIG. 3A appear with the locations of raised surface boundaries 216-A and 216-B corresponding to the designated surface route of the taxi clearance.

Figure 4D:
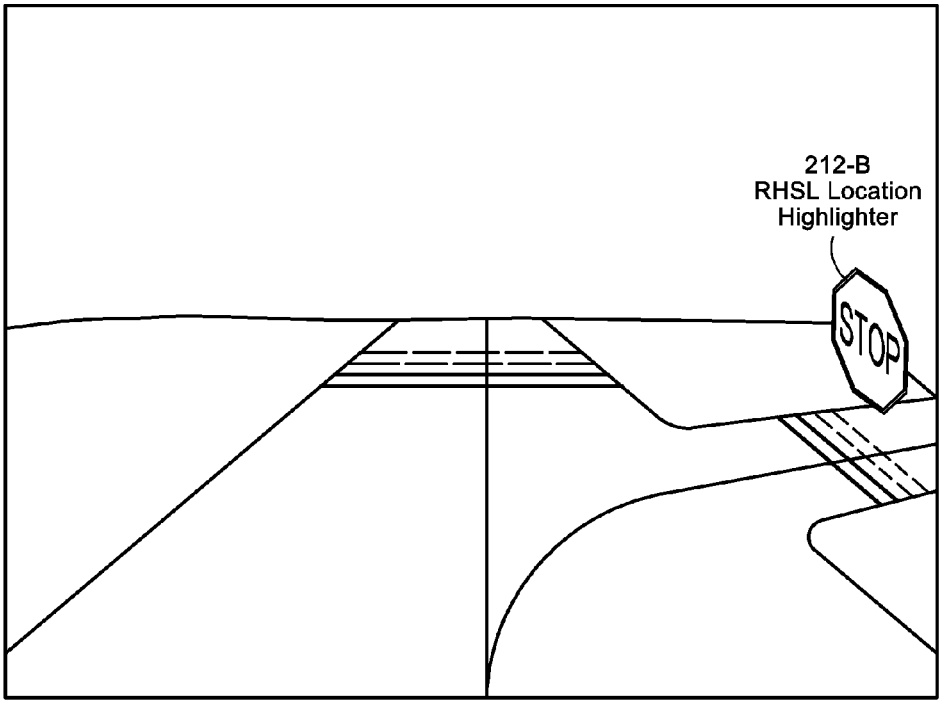
FIG. 4D depicts an image presenting a single RHSL location highlighter.
Figure 4E:
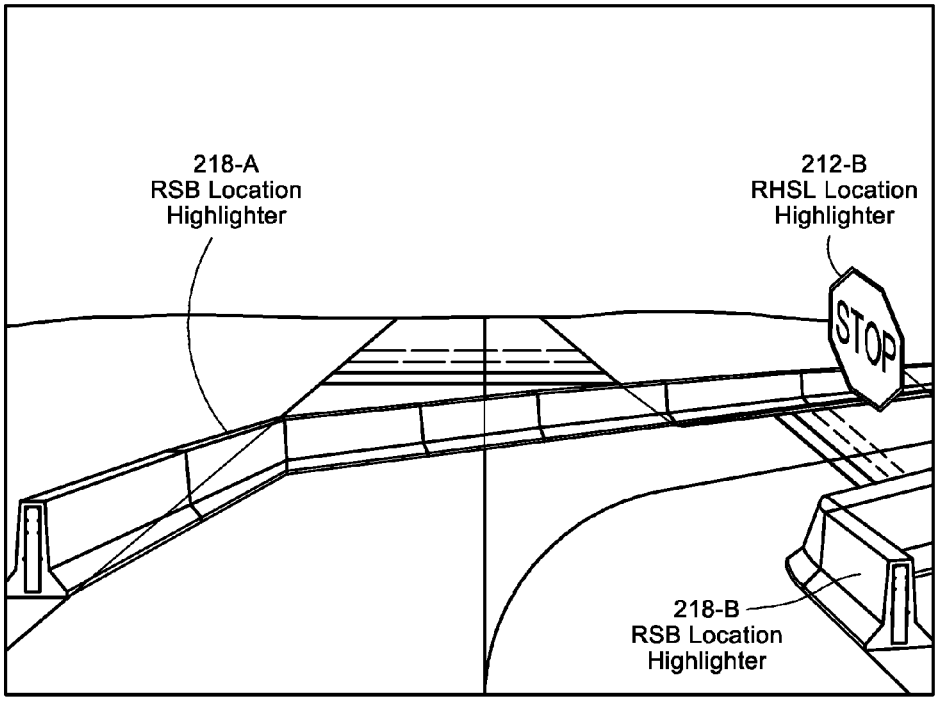
FIG. 4E depicts an image presenting a single RHSL location highlighter and a plurality of RSB location highlighters.
Figure 4F:
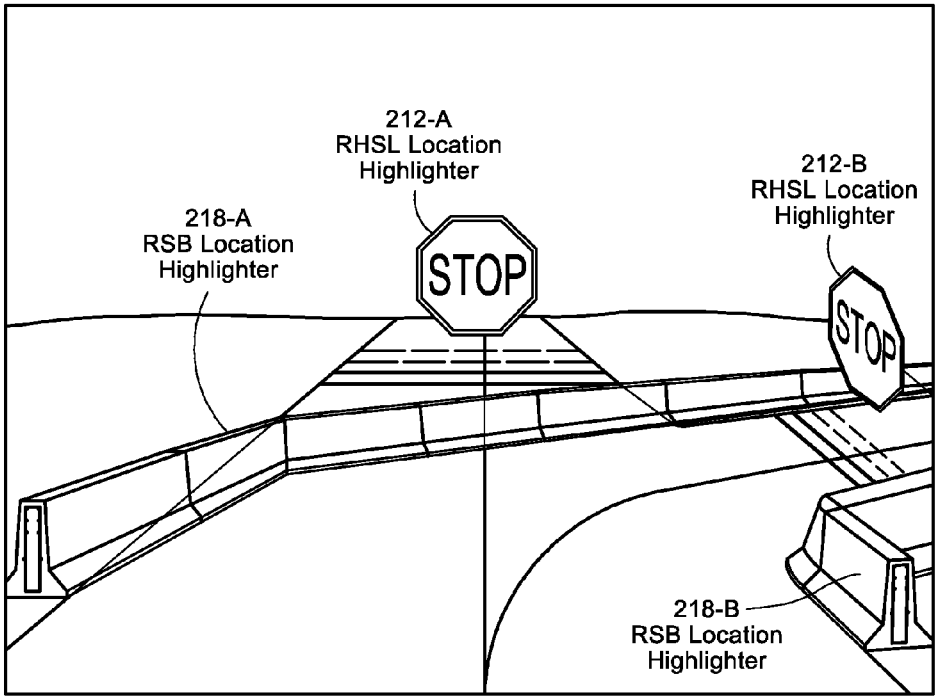
FIG. 4F depicts an image presenting a plurality of RHSLs and a plurality of RSBs.

Referring to FIGS. 4D through 4F, it will be assumed that the taxi clearance includes the present taxiway, the next taxiway, and a "hold-short" instruction corresponding to the surface hold-short lines 210-B; that is, both taxiways are designated surface routes. As illustrated in FIG. 4D, the raised hold-short line 212-B appears above surface hold-short lines 210-B corresponding to the designated surface route of the taxi clearance. As illustrated in FIG. 4E, the raised hold-short line 212-B of FIG. 4D appears with the locations of raised surface boundaries 218-A and 218-B (which includes raised surface transition barriers that are disclosed in the Scherer reference) corresponding to the designated surface route of the taxi clearance. As illustrated in FIG. 4F, the raised hold-short lines 212-A and 212-B of FIG. 3A appear with the locations of raised surface boundaries 218-A and 218-B corresponding to the designated surface route of the taxi clearance.

Figure 5A:
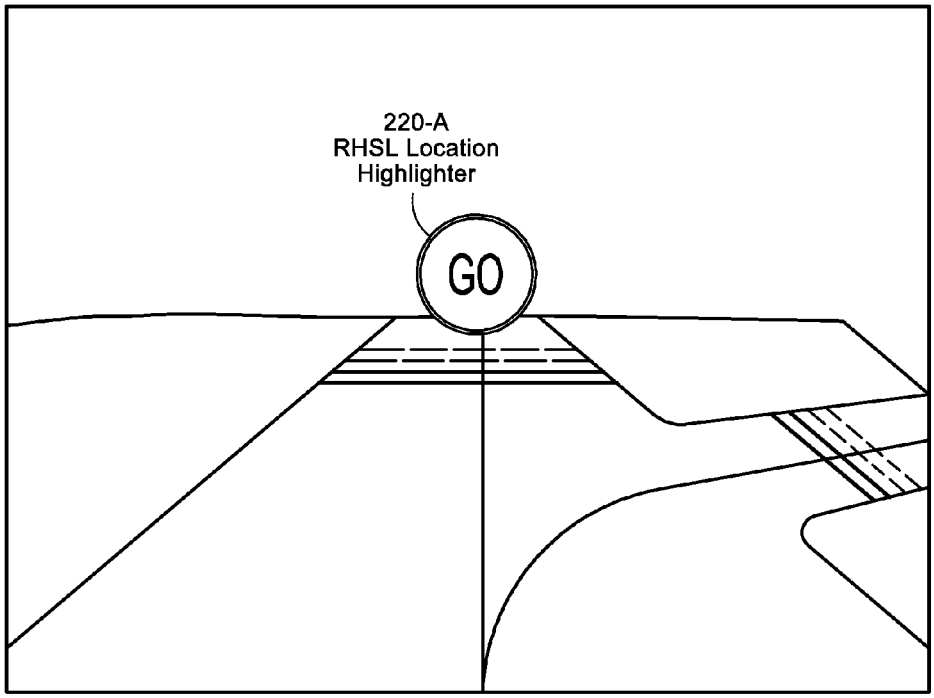
FIG. 5A depicts an image presenting a single RHSL location highlighter.
Figure 5B:
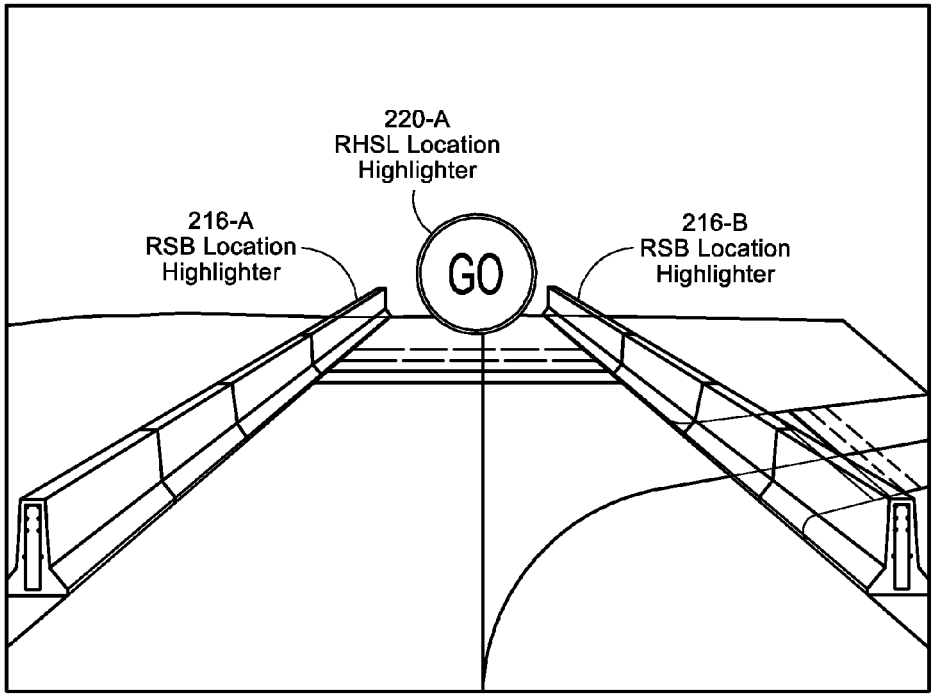
FIG. 5B depicts an image presenting a single RHSL location highlighter and a plurality of RSB location highlighters.
Figure 5C:
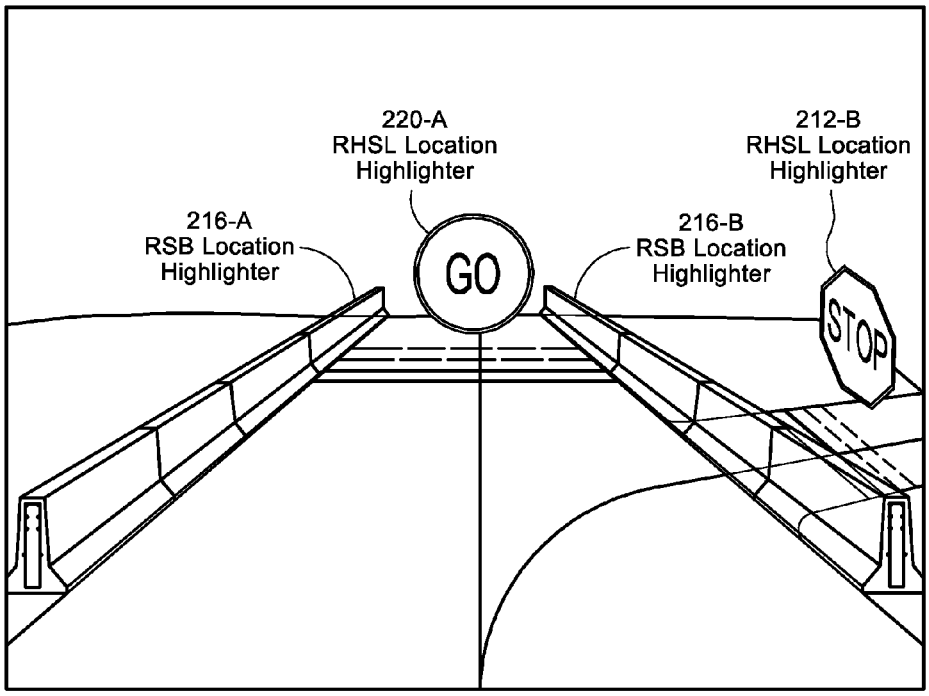
FIG. 5C depicts an image presenting a plurality of RHSL location highlighters and a plurality of RSB location highlighters.

Referring to FIGS. 5A through 5C, it will be assumed that taxi data has been provided to the processor 140 and that the taxi clearance includes the present taxiway 202 and a "cross" instruction (or equivalent instruction) corresponding to the surface hold-short lines 210-A. As illustrated in FIG. 5A, a raised hold-short line 220-A illustrated as "go" light (or sign) appears above surface hold-short lines 210-A corresponding to the designated surface route of the taxi clearance; for display units configured to display a plurality of colors, the "go" light could be presented in green and/or without text. As illustrated in FIG. 5B, the raised hold-short line 220-A of FIG. 5A appears with the locations of raised surface boundaries 216-A and 216-B corresponding to the designated surface route of the taxi clearance. As illustrated in FIG. 5C, the raised hold-short line 220-A and the raised hold-short line 212-B appear with the locations of raised surface boundaries 216-A and 216-B corresponding to the designated surface route of the taxi clearance.

Figure 5D:
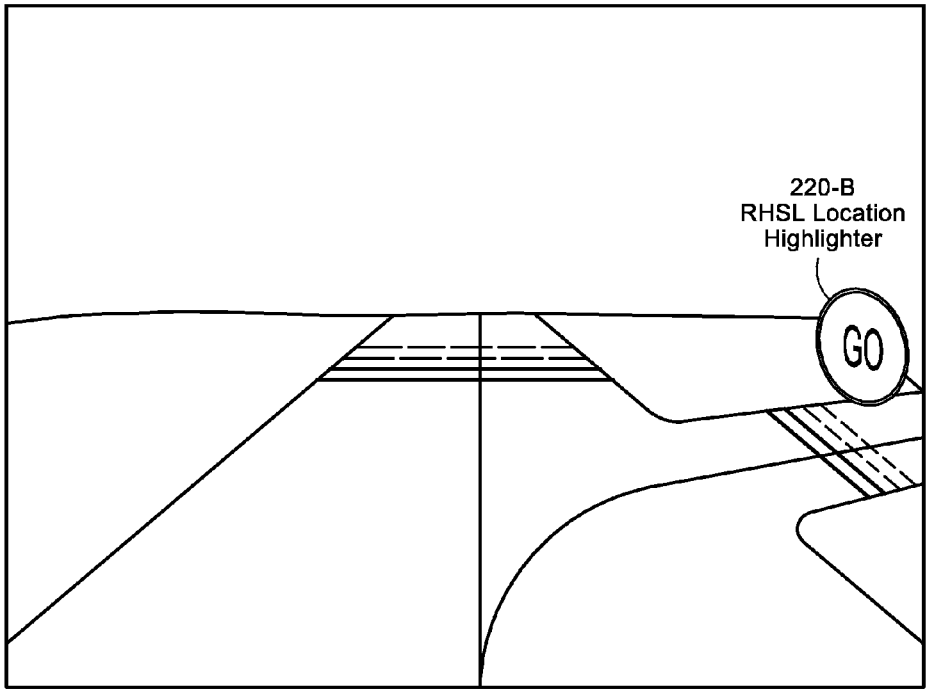
FIG. 5D depicts an image presenting a single RHSL location highlighter.
Figure 5E:
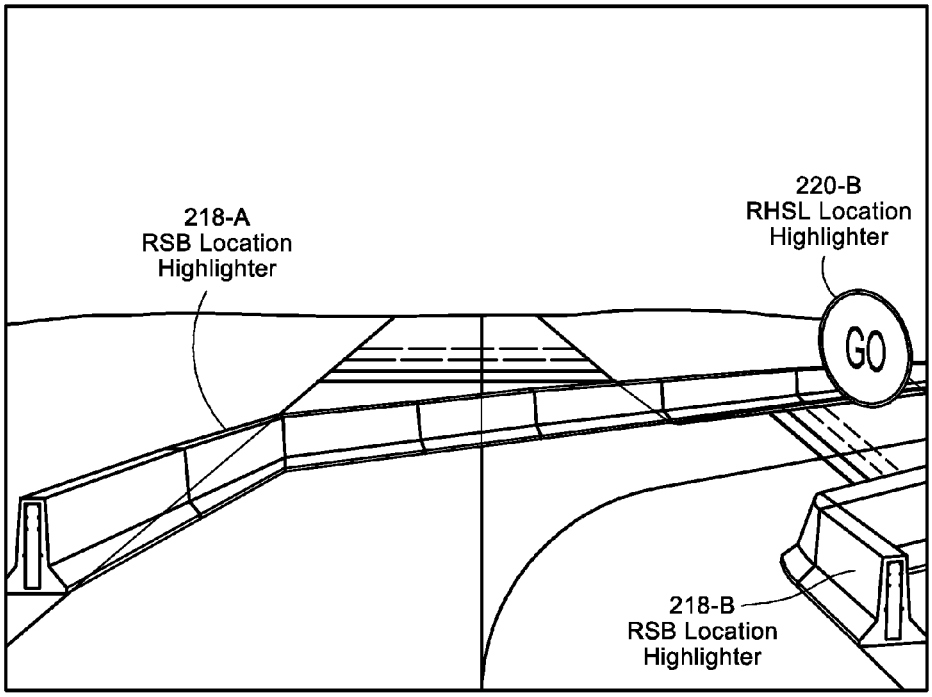
FIG. 5E depicts an image presenting a single RHSL location highlighter and a plurality of RSB location highlighters.
Figure 5F:
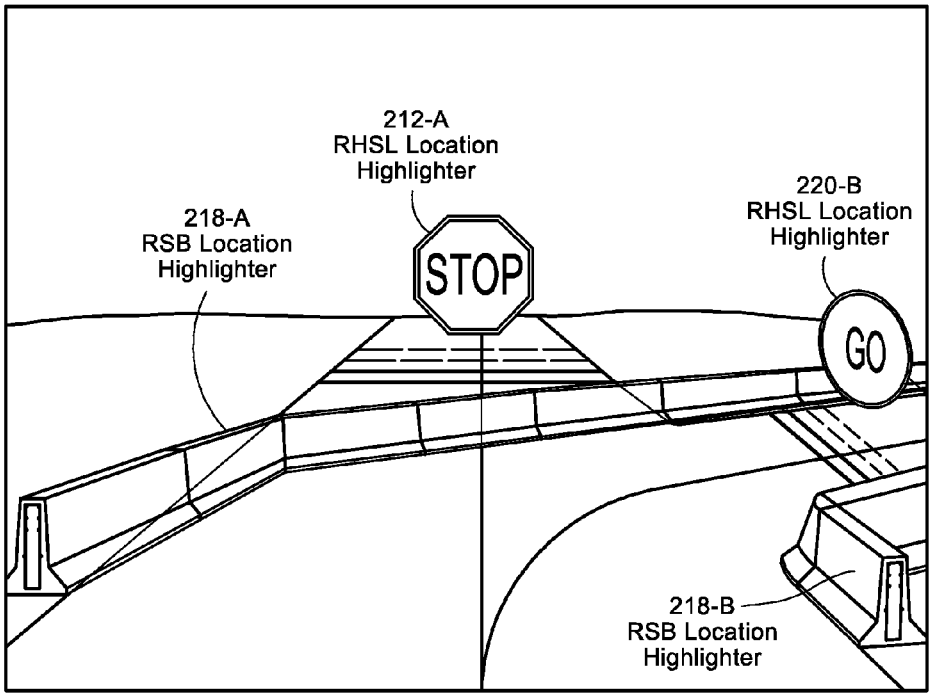
FIG. 5F depicts an image presenting a plurality of RHSL location highlighters and a plurality of RSB location highlighters.

Referring to FIGS. 5D through 5F, it will be assumed that the taxi clearance includes the present taxiway, the next taxiway, and a "cross" instruction corresponding to the surface hold-short lines 210-B. As illustrated in FIG. 5D, the raised hold-short line 220-B appears above surface hold-short lines 210-B corresponding to the designated surface route of the taxi clearance. As illustrated in FIG. 5E, the raised hold-short line 220-B of FIG. 5D appears with the locations of raised surface boundaries 218-A and 218-B corresponding to the designated surface route of the taxi clearance. As illustrated in FIG. 5F, the raised hold-short lines 220-B and 212-A appear with the locations of raised surface boundaries 218-A and 218-B corresponding to the designated surface route of the taxi clearance.

Figure 6:
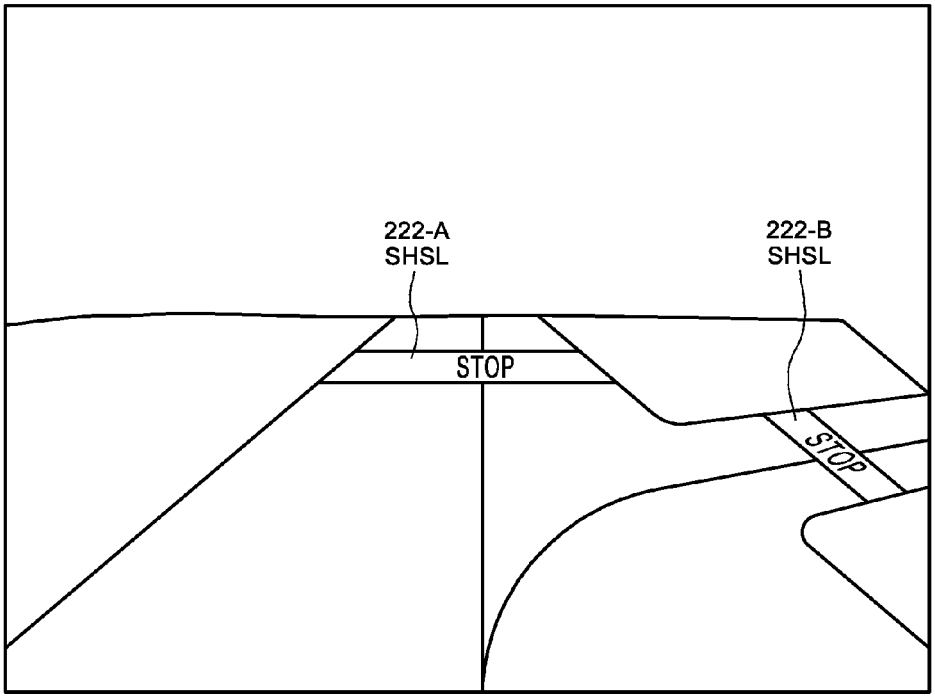
FIG. 6 depicts an image presenting a plurality of single hold-short line ("SHSL") location highlighters.

In addition to the raised hold-short lines discussed above, surface hold-short lines may be replaced with unconventional markings and presented on the display unit(s). Referring to FIG. 6, it will be assumed that taxi data has not been provided to the processor 140. As illustrated, surface hold-short lines 210-A and 210-B appearing in the scene located outside the aircraft are replaced with an unconventional surface marking such as, but not limited to, single hold-short line 222-A and 222-B that conveys the presence of surface hold-short lines 210-A and 210-B (shown as "SHSL" in the drawings). For display units configured to display a plurality of colors, the single hold-short lines 222-A and 222-B could be presented in red; for any display units, the single hold-short lines 222-A and 222-B could include any text that conveys the presence of surface hold-short lines 210-A and 210-B. The single hold-short lines 222-A and 222-B could convey to the pilot that he or she will "cross" surface hold-short lines 210-A and 210-B, respectively. As embodied herein, single hold-short lines may be presented with various levels of transparency.

Figure 7A:
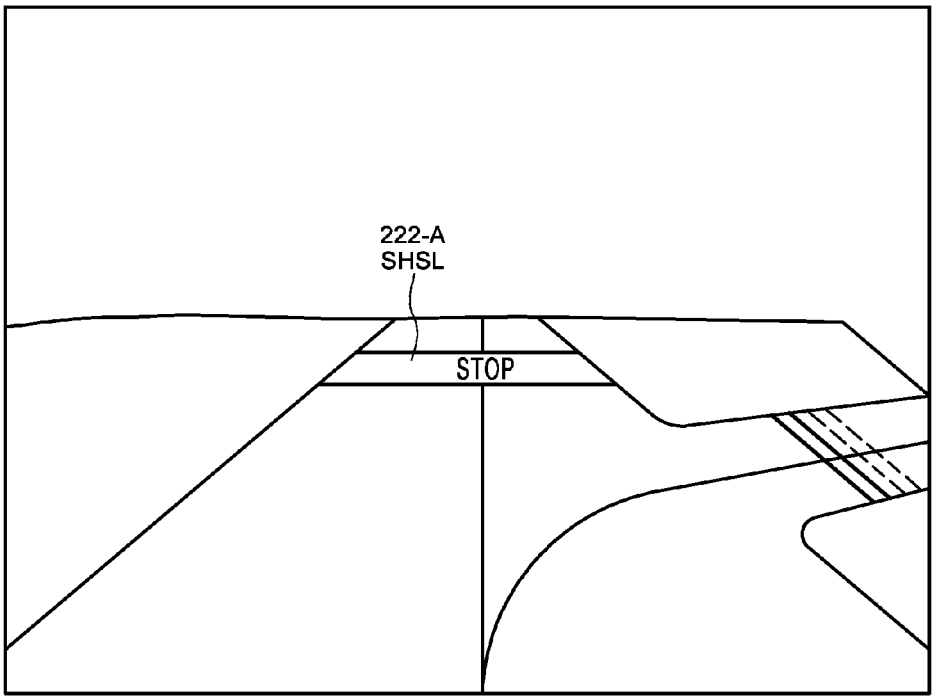
FIG. 7A depicts an image presenting a single SHSL location highlighter.
Figure 7B:
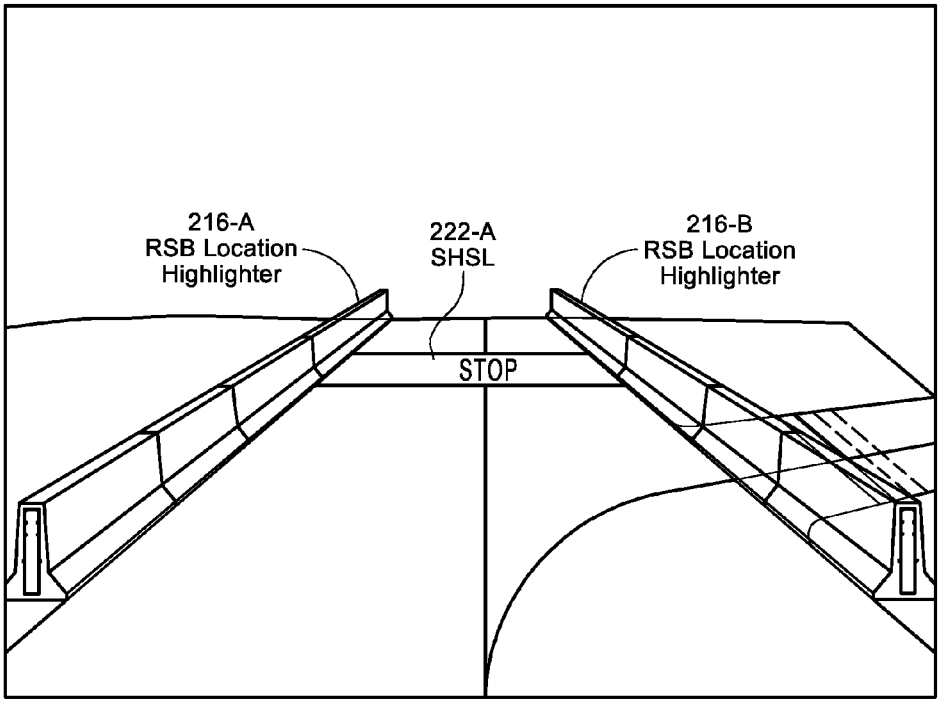
FIG. 7B depicts an image presenting a single SHSL location highlighter and a plurality of RSB location highlighters.
Figure 7C:
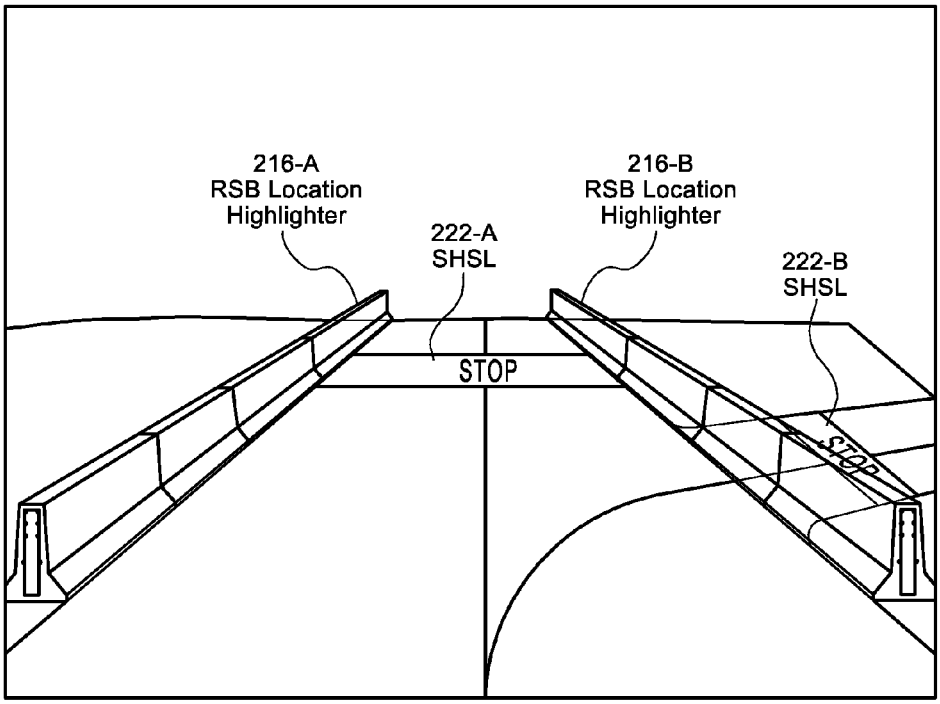
FIG. 7C depicts an image presenting a plurality of SHSL location highlighters and a plurality of RSB location highlighters.

Referring to FIGS. 7A through 7C, it will be assumed that taxi data has been provided to the processor 140 and that the taxi clearance includes the present taxiway 202 and a "hold-short" instruction corresponding to the surface hold-short lines 210-A. As illustrated in FIG. 7A, the single hold-short line 222-A replaces the surface hold-short lines 210-A corresponding to the designated surface route of the taxi clearance. As illustrated in FIG. 7B, the single hold-short line 222-A of FIG. 7A appears with the locations of raised surface boundaries 216-A and 216-B corresponding to the designated surface route of the taxi clearance. As illustrated in FIG. 7C, the single hold-short lines 222-A and 222-B of FIG. 6 appear with the locations of raised surface boundaries 216-A and 216-B corresponding to the designated surface route of the taxi clearance.

Figure 7D:
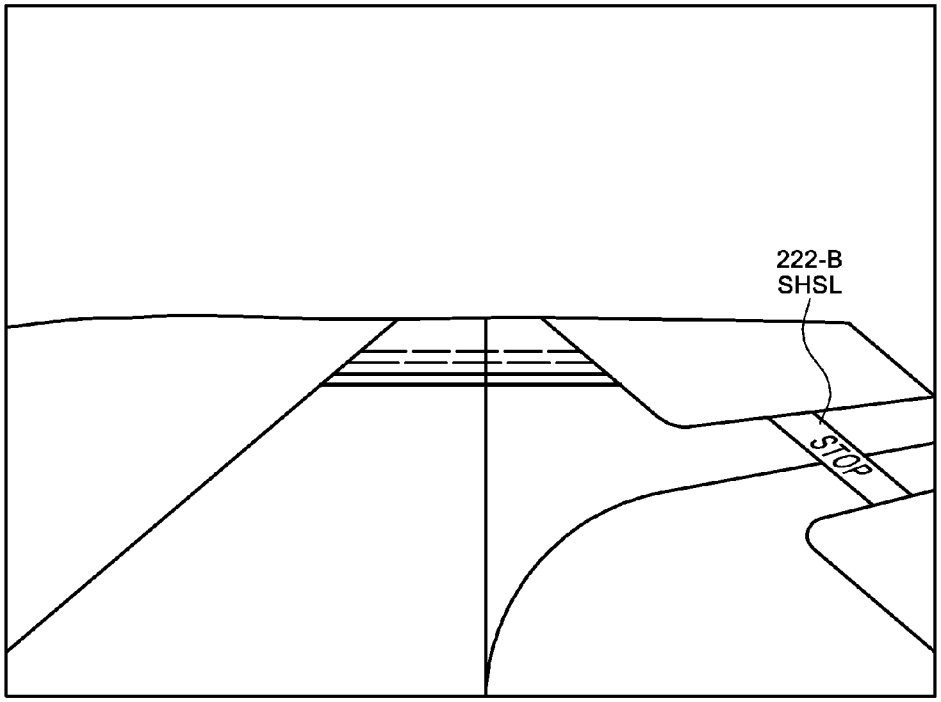
FIG. 7D depicts an image presenting a single SHSL location highlighter.
Figure 7E:
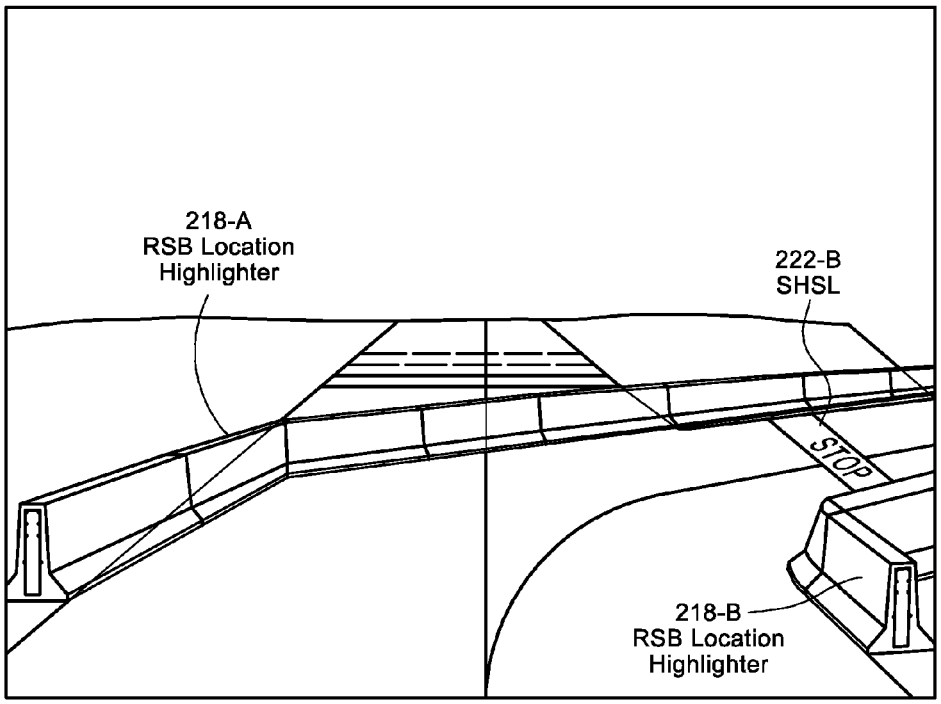
FIG. 7E depicts an image presenting a single SHSL location highlighter and a plurality of RSB location highlighters.
Figure 7F:
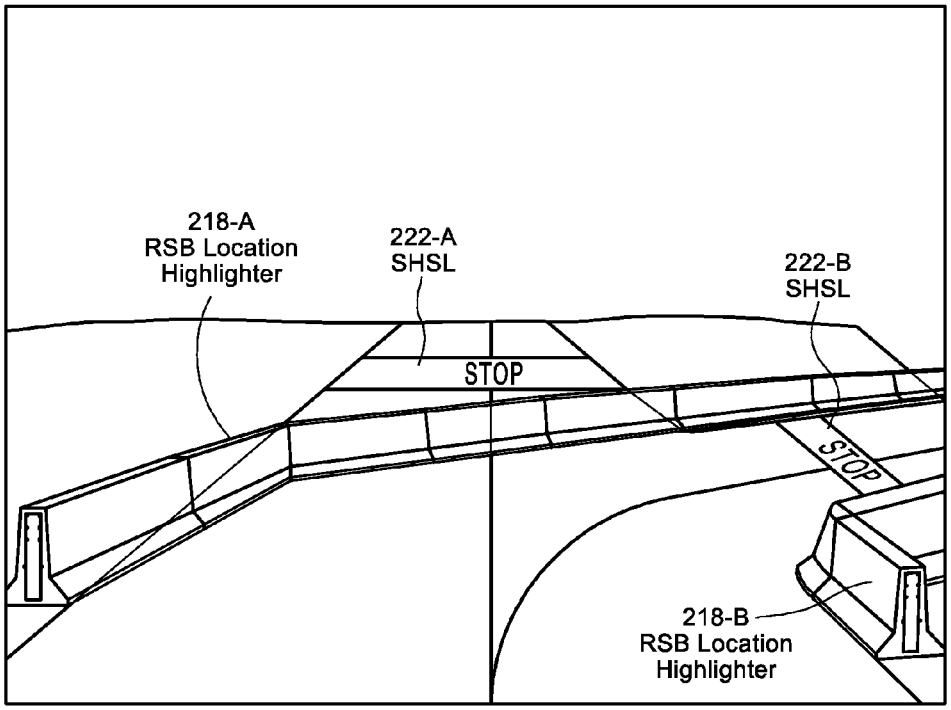
FIG. 7F depicts an image presenting a plurality of SHSL location highlighters and a plurality of RSB location highlighters.

Referring to FIGS. 7D through 7F, it will be assumed that the taxi clearance includes the present taxiway, the next taxiway, and a "hold-short" instruction corresponding to the surface hold-short lines 210-B. As illustrated in FIG. 7D, the single hold-short line 222-B replaces the surface hold-short lines 210-B corresponding to the designated surface route of the taxi clearance. As illustrated in FIG. 7E, the single hold-short line 222-B of FIG. 7D appears with the locations of raised surface boundaries 218-A and 218-B corresponding to the designated surface route of the taxi clearance. As illustrated in FIG. 7F, the single hold-short lines 222-A and 222-B of FIG. 6 appear with the locations of raised surface boundaries 218-A and 218-B corresponding to the designated surface route of the taxi clearance.

Figure 8A:
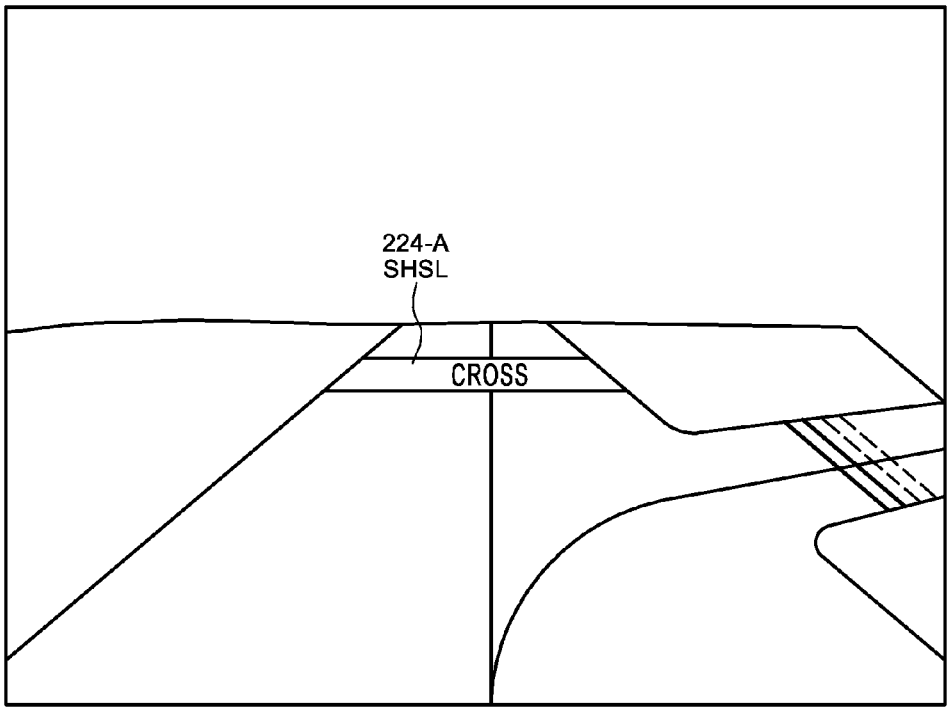
FIG. 8A depicts an image presenting a single SHSL location highlighter.
Figure 8B:
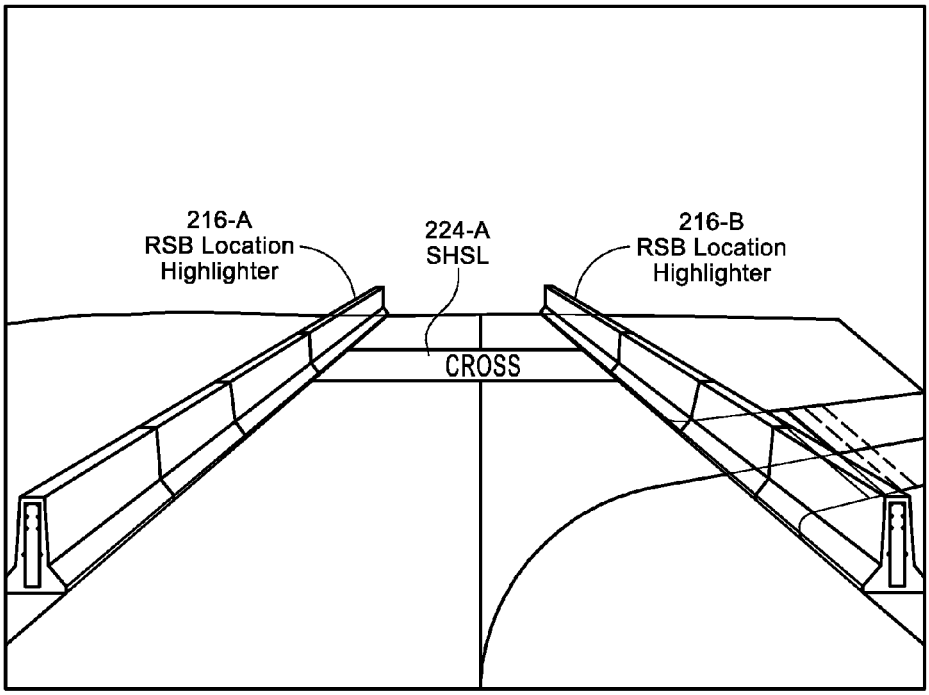
FIG. 8B depicts an image presenting a single SHSL location highlighter and a plurality of RSB location highlighters.
Figure 8C:
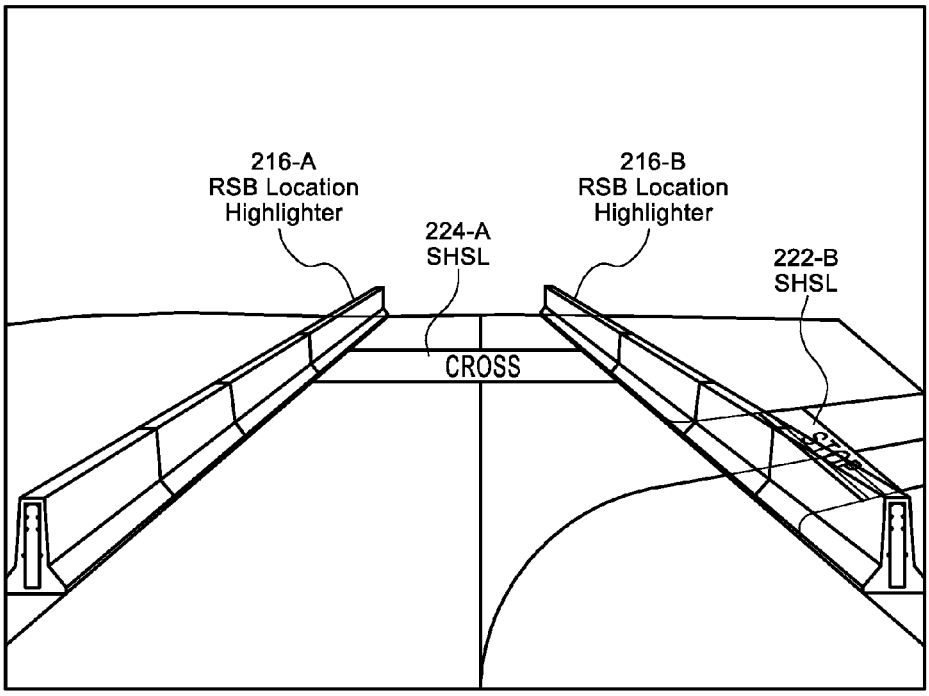
FIG. 8C depicts an image presenting a plurality of SHSL location highlighters and a plurality of RSB location highlighters.

Referring to FIGS. 8A through 8C, it will be assumed that taxi data has been provided to the processor 140 and that the taxi clearance includes the present taxiway 202 and a "cross" instruction corresponding to the surface hold-short lines 210-A. As illustrated in FIG. 8A, the single hold-short line 224-A corresponding to the "cross" instruction replaces the surface hold-short lines 210-A corresponding to the designated surface route of the taxi clearance. For display units configured to display a plurality of colors, the single hold-short line 224-A could be presented in green; for any display units, the single hold-short line 224-A could include any text that conveys the "cross" instruction.

As illustrated in FIG. 8B, the single hold-short line 224-A of FIG. 8A appears with the locations of raised surface boundaries 216-A and 216-B corresponding to the designated surface route of the taxi clearance. As illustrated in FIG. 8C, the single hold-short lines 224-A and 222-B appear with the locations of raised surface boundaries 216-A and 216-B corresponding to the designated surface route of the taxi clearance.

Figure 8D:
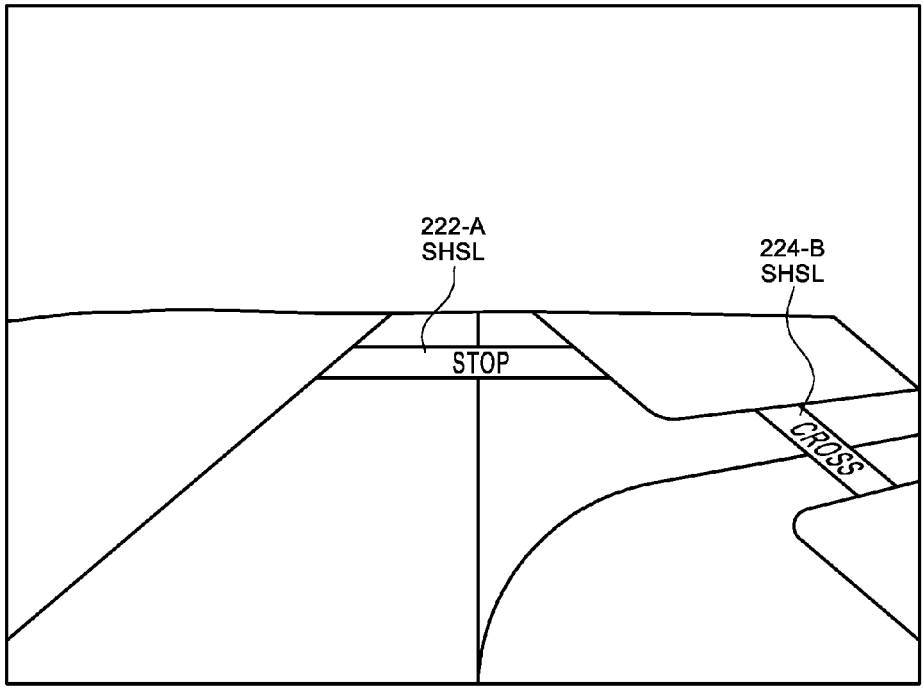
FIG. 8D depicts an image presenting a plurality of SHSL location highlighters.
Figure 8E:
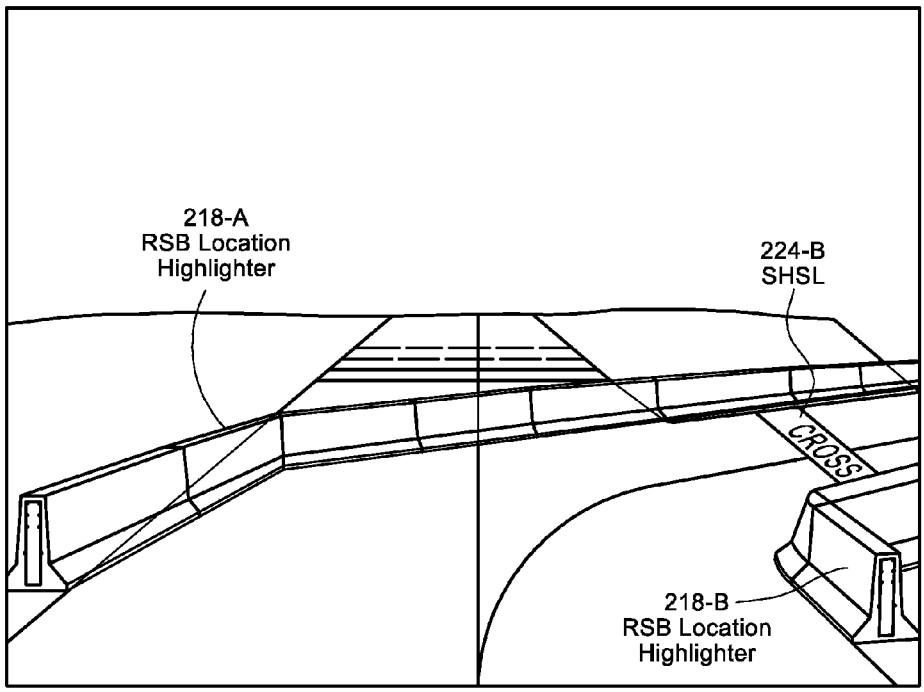
FIG. 8E depicts an image presenting a single SHSL location highlighter and a plurality of RSB location highlighters.
Figure 8F:
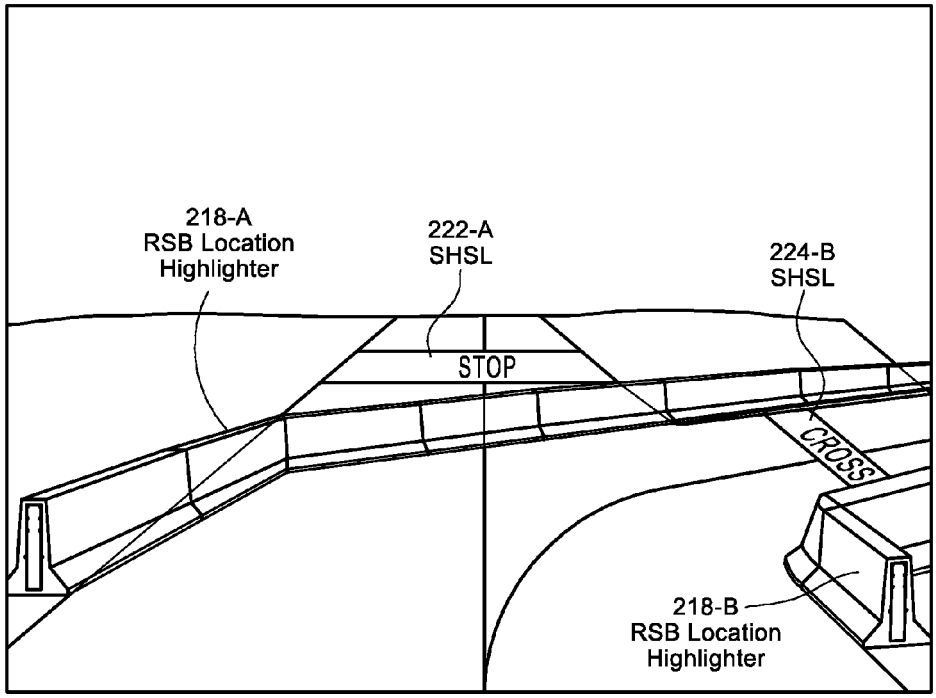
FIG. 8F depicts an image presenting a plurality of SHSL location highlighters and a plurality of RSB location highlighters.
Figure 9A:
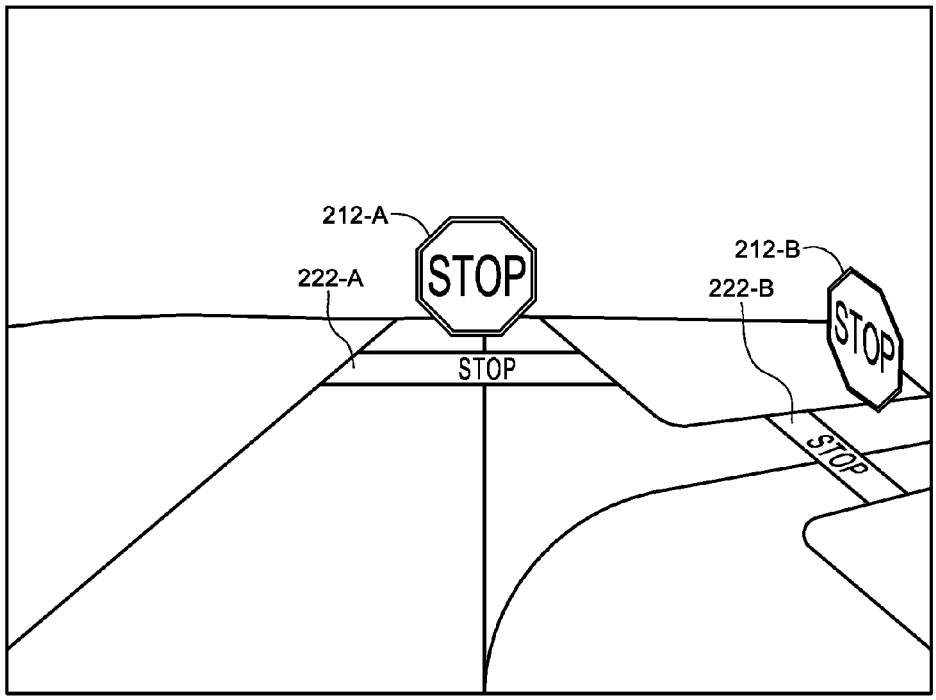
FIG. 9A depicts an image presenting a plurality of RHSL location highlighters and a plurality of SHSL location highlighters.
Figure 9B:
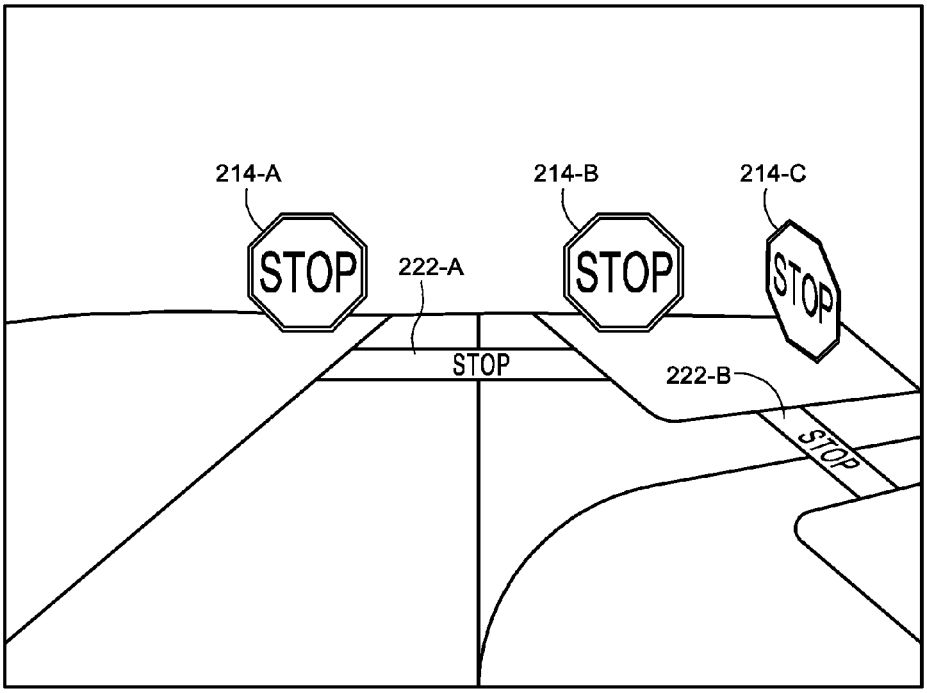
FIG. 9B depicts an image presenting a plurality of RHSL location highlighters and a plurality of SHSL location highlighters.

Referring to FIGS. 8D through 8F, it will be assumed that the taxi clearance includes the present taxiway, the next taxiway, and a "cross" instruction corresponding to the surface hold-short lines 210-B. As illustrated in FIG. 8D, the single hold-short line 224-B corresponding to the "cross" instruction replaces the surface hold-short lines 210-B corresponding to the designated surface route of the taxi clearance. For display units configured to display a plurality of colors, the single hold-short line 224-B could be presented in green; for any display units, the single hold-short line 224-B could include any text that conveys the "cross" instruction.

As illustrated in FIG. 8E, the single hold-short line 224-B of FIG. 8A appears with the locations of raised surface boundaries 218-A and 218-B corresponding to the designated surface route of the taxi clearance. As illustrated in FIG. 8F, the single hold-short lines 224-B and 222-A appear with the locations of raised surface boundaries 218-A and 218-B corresponding to the designated surface route of the taxi clearance.

Figure 10A:
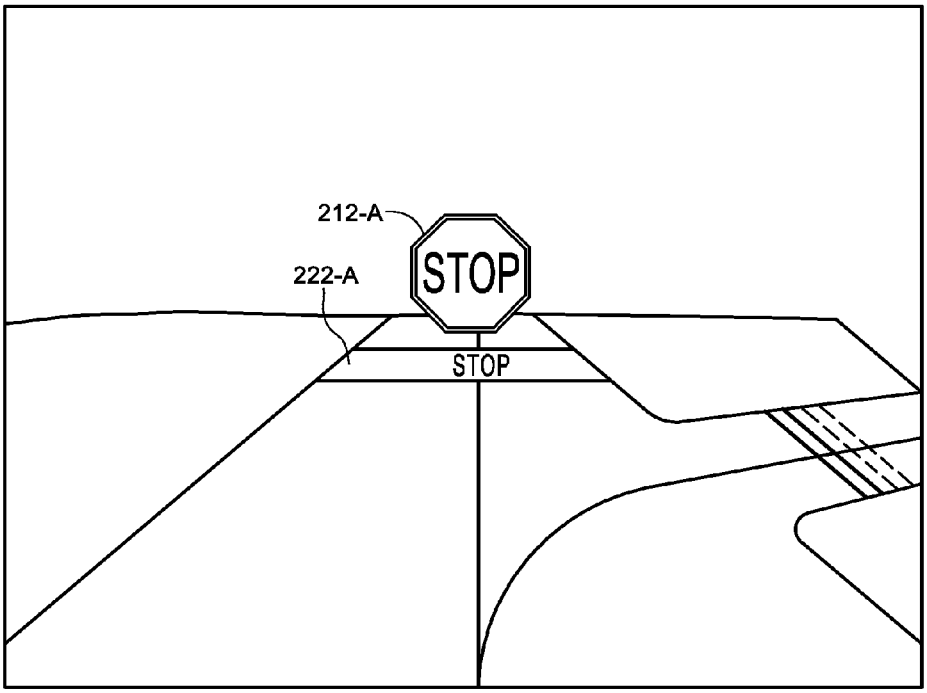
FIG. 10A depicts an image presenting a single RHSL location highlighter and a single SHSL location highlighter.
Figure 10B:
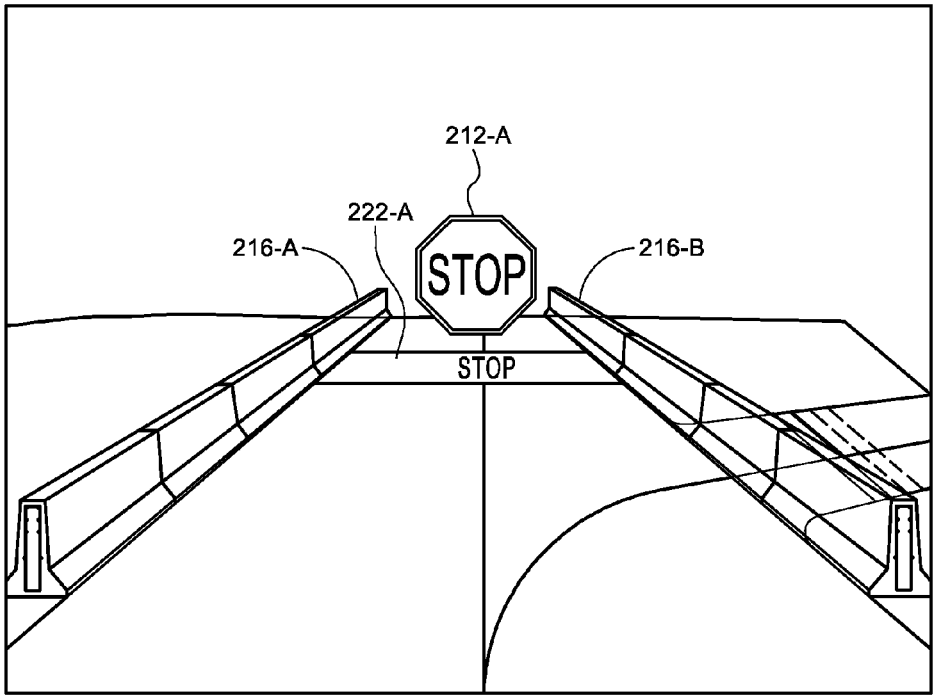
FIG. 10B depicts an image presenting a single RHSL location highlighter, a single SHSL location highlighter, and a plurality of RSB location highlighters.
Figure 10C:
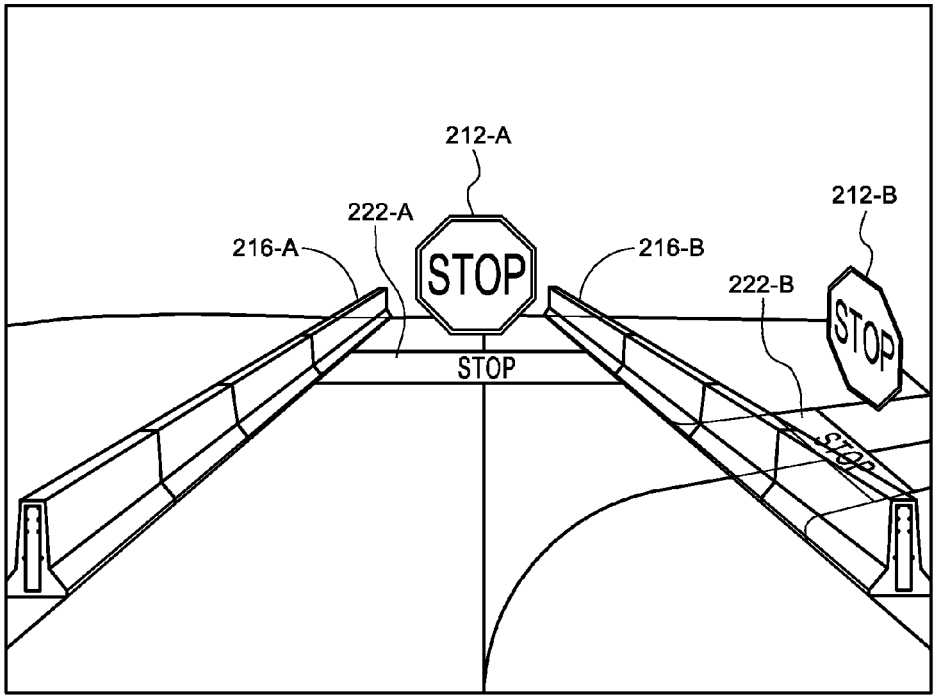
FIG. 10C depicts an image presenting a plurality of RHSL location highlighters, a plurality of SHSL location highlighters, and a plurality of RSB location highlighters.
Figure 10D:
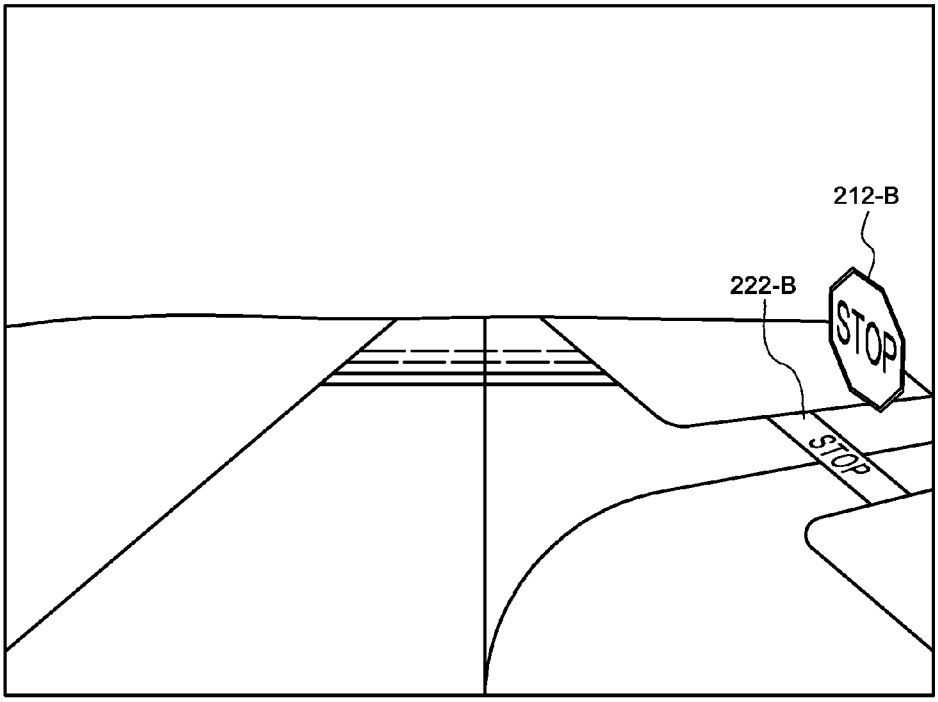
FIG. 10D depicts an image presenting a single RHSL location highlighter and a single SHSL location highlighter.
Figure 10E:
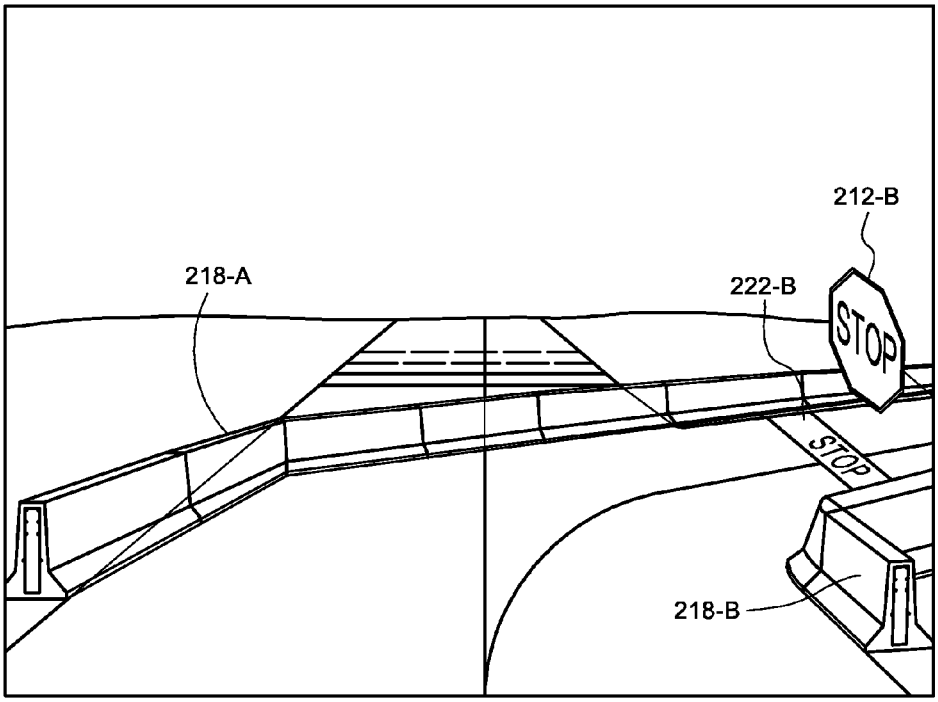
FIG. 10E depicts an image presenting a single RHSL location highlighter, a single SHSL location highlighter, and a plurality of RSB location highlighters.
Figure 10F:
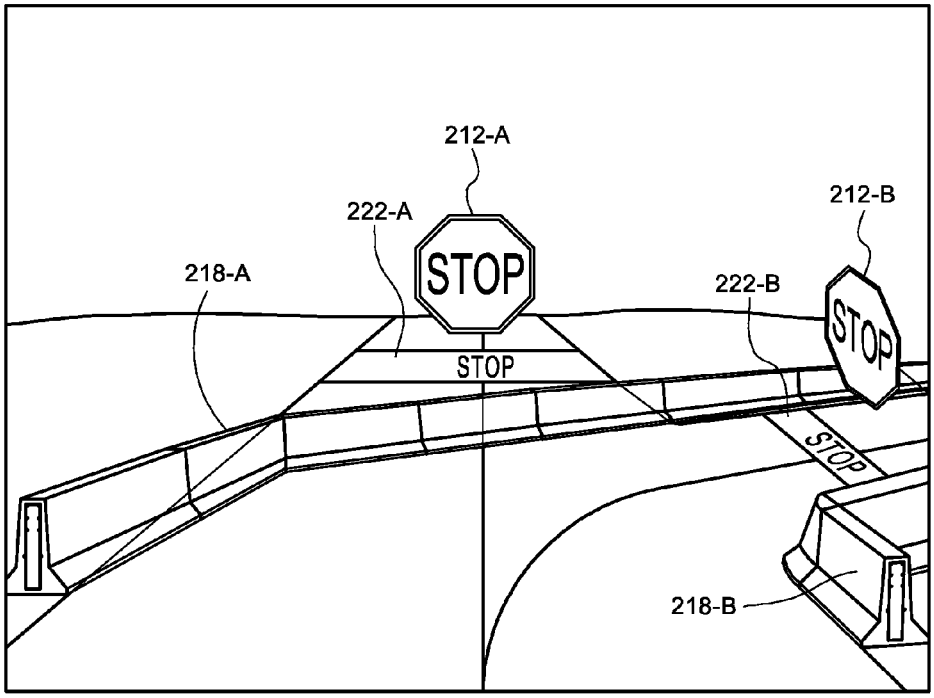
FIG. 10F depicts an image presenting a plurality of RHSL location highlighters, a plurality of SHSL location highlighters, and a plurality of RSB location highlighters.
Figure 11A:
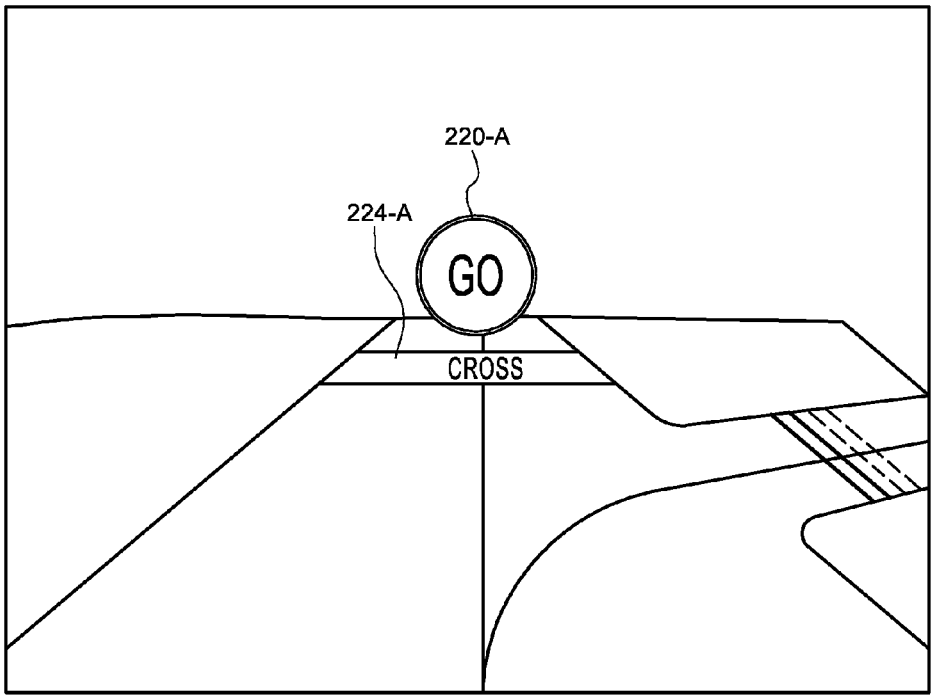
FIG. 11A depicts an image presenting a single RHSL location highlighter and a single SHSL location highlighter.
Figure 11B:
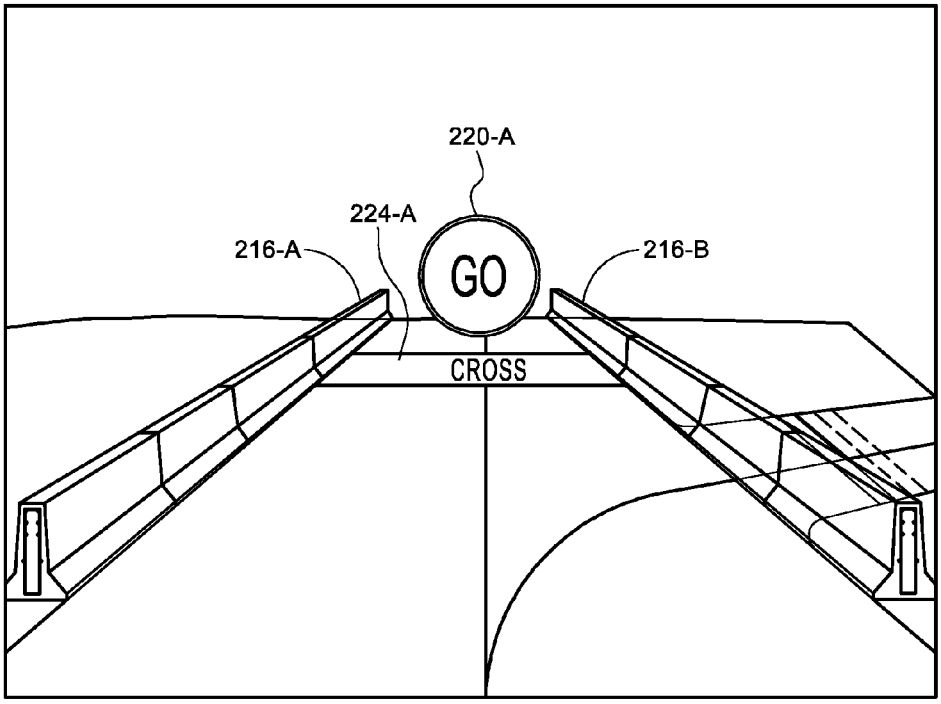
FIG. 11B depicts an image presenting a single RHSL location highlighter, a single SHSL location highlighter, and a plurality of RSB location highlighters.
Figure 11C:
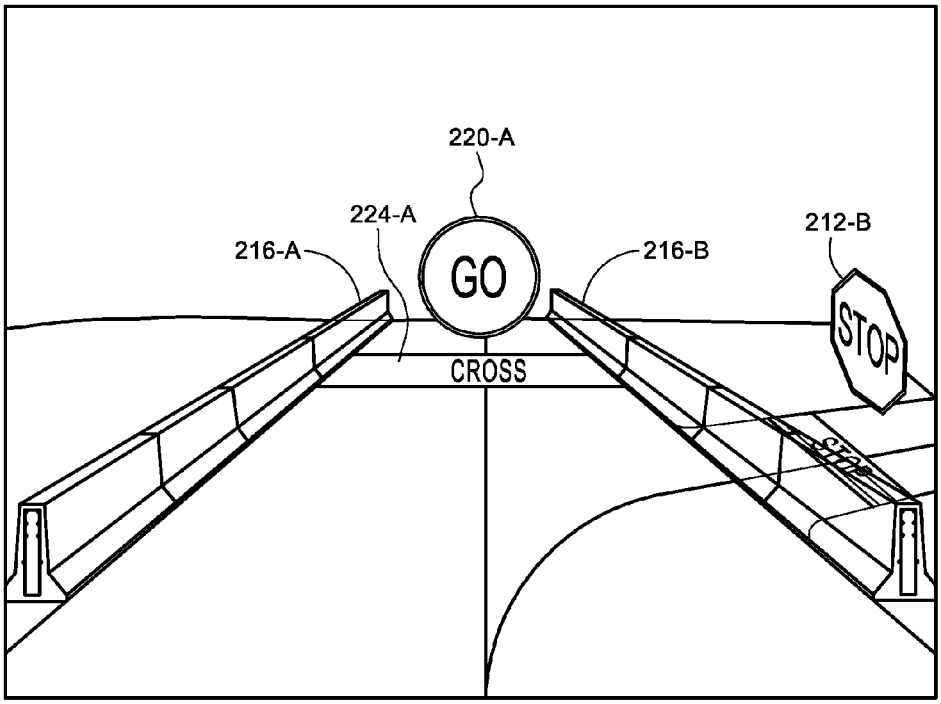
FIG. 11C depicts an image presenting a plurality of RHSL location highlighters, a plurality of SHSL location highlighters, and a plurality of RSB location highlighters.
Figure 11D:
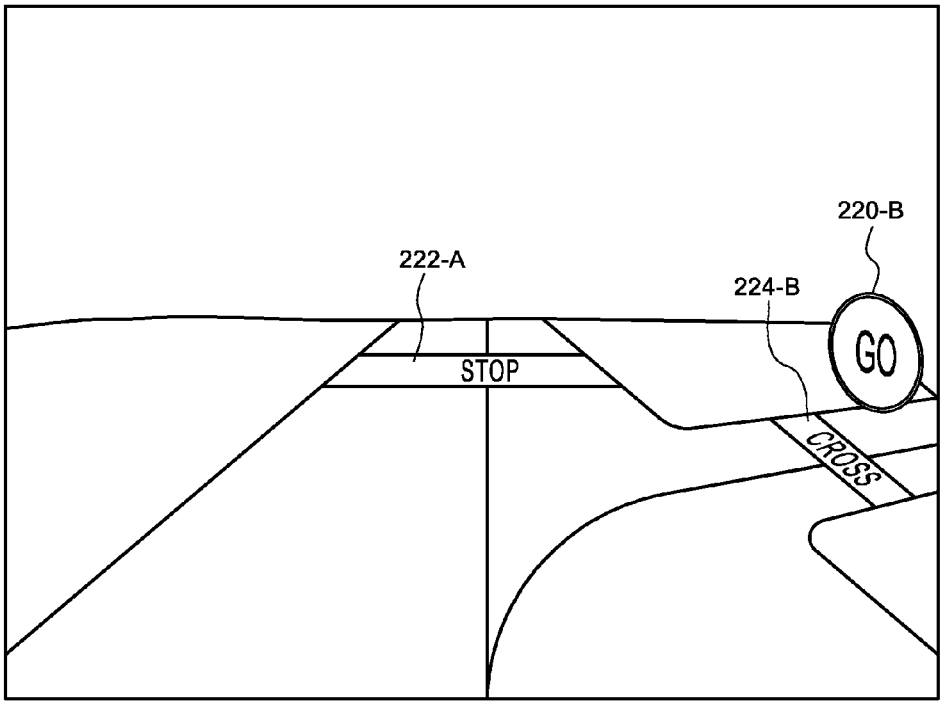
FIG. 11D depicts an image presenting a single RHSL location highlighter and a single SHSL location highlighter.
Figure 11E:
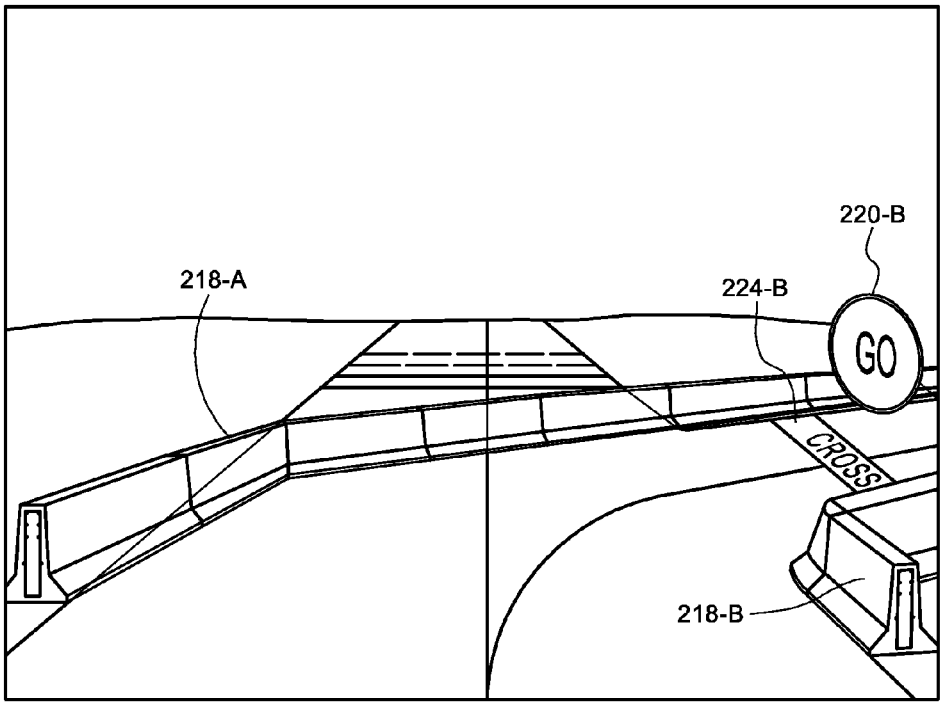
FIG. 11E depicts an image presenting a single RHSL location highlighter, a single SHSL location highlighter, and a plurality of RSB location highlighters.
Figure 11F:
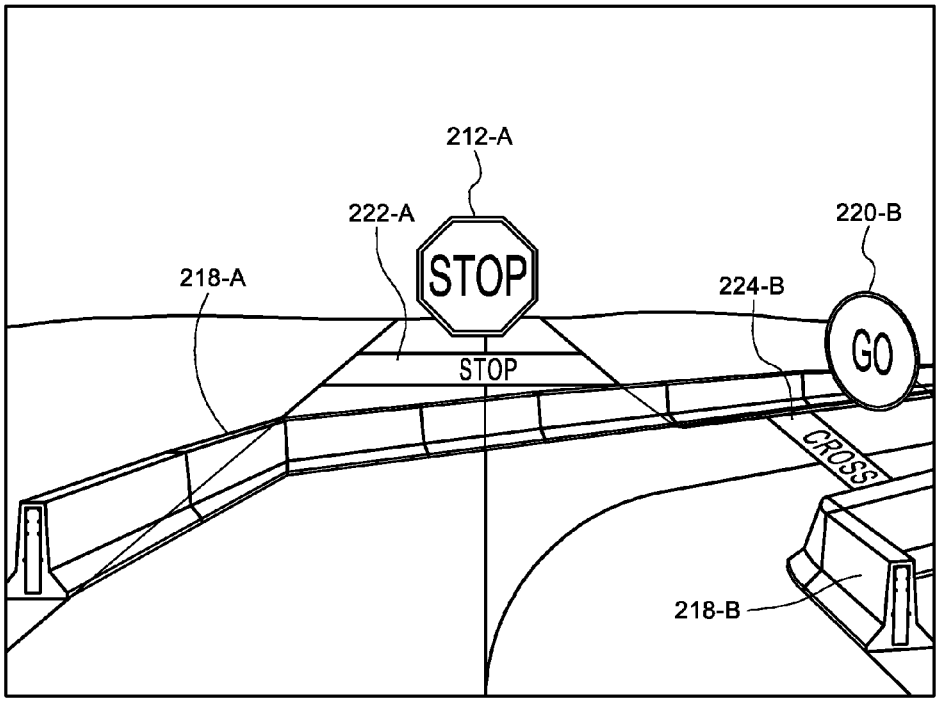
FIG. 11F depicts an image presenting a plurality of RHSL location highlighters, a plurality of SHSL location highlighters, and a plurality of RSB location highlighters.
Figure 12A:
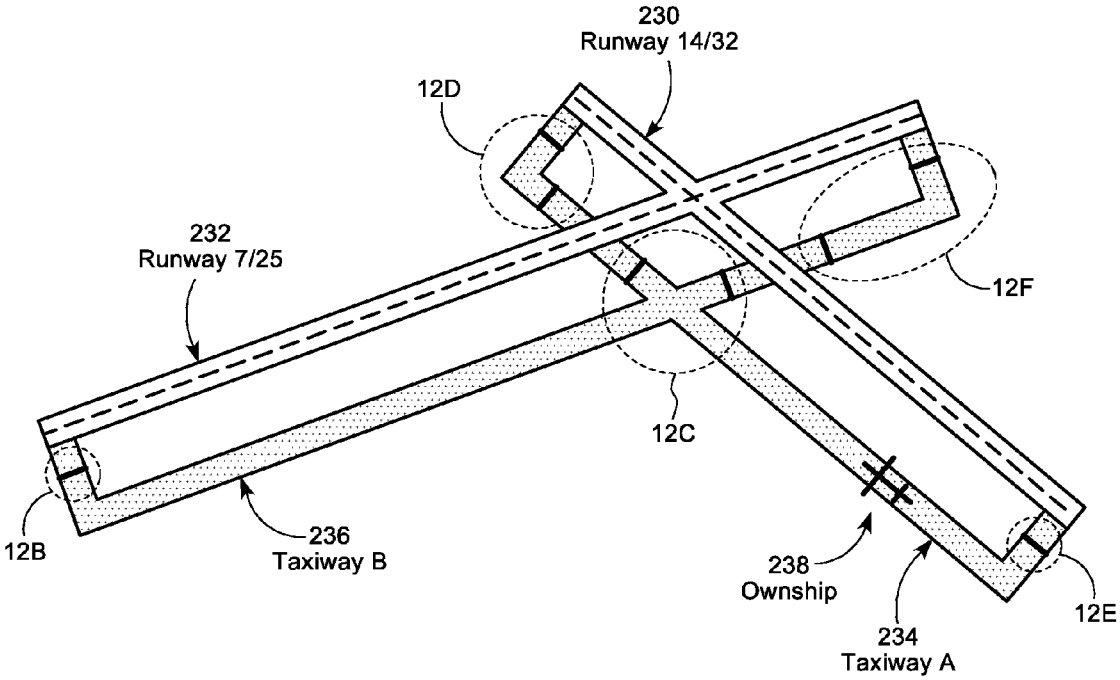
FIG. 12A illustrates an image of airport surface map ("ASM") with a plurality of sets of conventional surface hold-short lines.
Figure 12B:
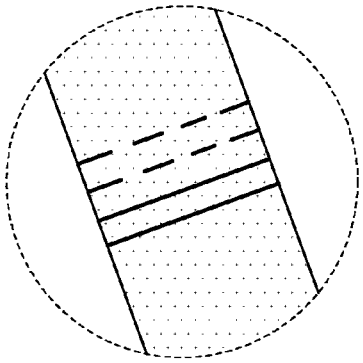
FIG. 12B illustrates one set of conventional surface hold-short lines depicted within the image of the ASM of FIG. 12A.
Figure 12C:
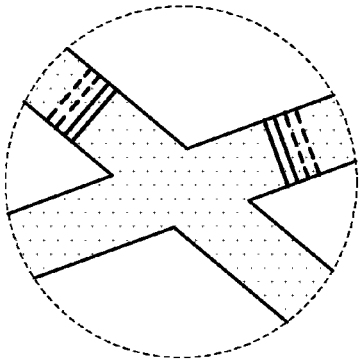
FIG. 12C illustrates two sets of conventional surface hold-short lines depicted within the image of the ASM of FIG. 12A.
Figure 12D:
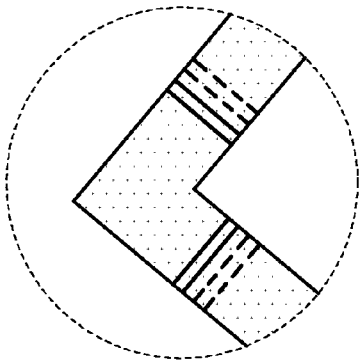
FIG. 12D illustrates two sets of conventional surface hold-short lines depicted within the image of the ASM of FIG. 12A.
Figure 12E:
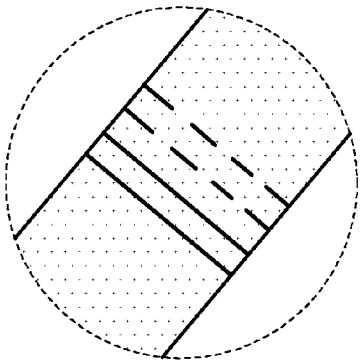
FIG. 12E illustrates one set of conventional surface hold-short lines depicted within the image of the ASM of FIG. 12A.
Figure 12F:
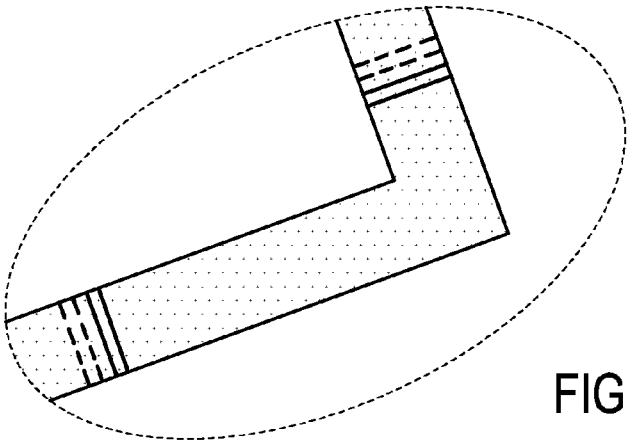
FIG. 12F illustrates two sets of conventional surface hold-short lines depicted within the image of the ASM of FIG. 12A.
Figure 13A:
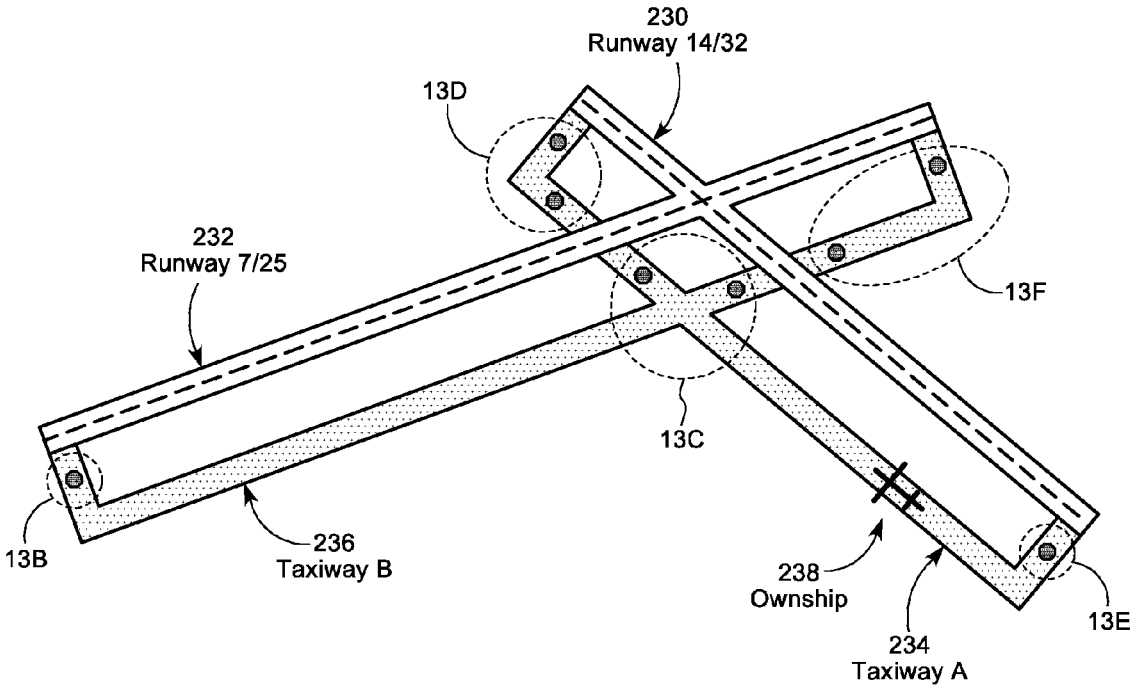
FIG. 13A illustrates an image of an ASM with a plurality of unconventional surface hold-short indicators.
Figure 13B:
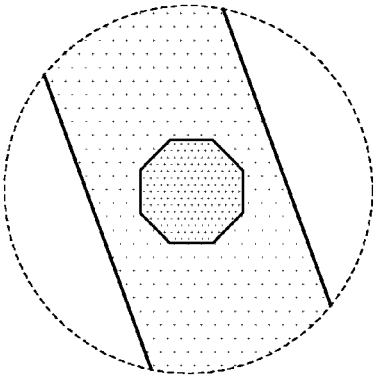
FIG. 13B illustrates one unconventional surface hold-short indicator depicted within the image of the ASM of FIG. 13A.
Figure 13C:
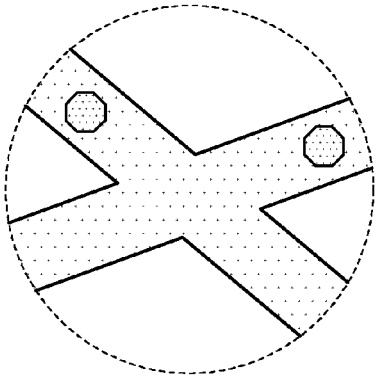
FIG. 13C illustrates two unconventional surface hold-short indicators depicted within the image of the ASM of FIG. 13A.
Figure 13D:
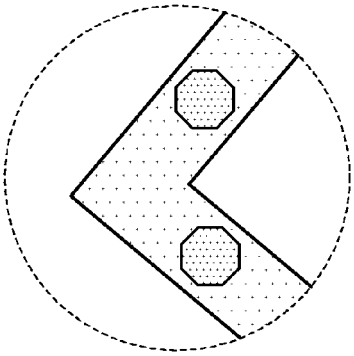
FIG. 13D illustrates two unconventional surface hold-short indicators depicted within the image of the ASM of FIG. 13A.
Figure 13E:
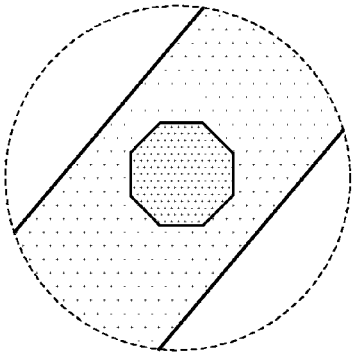
FIG. 13E illustrates one unconventional surface hold-short indicator depicted within the image of the ASM of FIG. 13A.
Figure 13F:
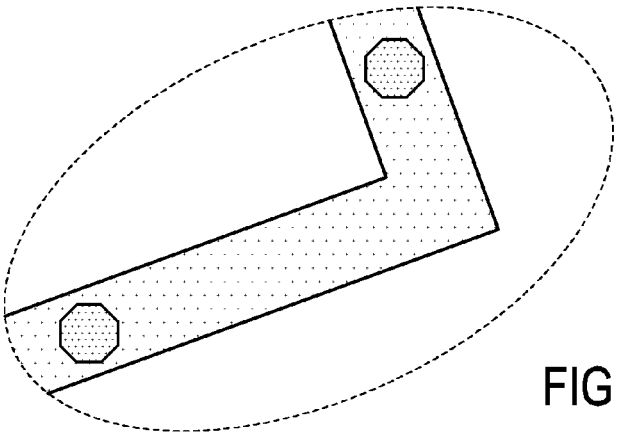
FIG. 13F illustrates two unconventional surface hold-short indicators depicted within the image of the ASM of FIG. 13A.

In addition to the individual presentations of the raised hold-short lines and the single hold-short line discussed above, these may be combined as presented on the display unit(s). For example, FIG. 9A has been formed by combining FIGS. 3A and 6, and FIG. 9B has been formed by combining FIGS. 3B and 6. Likewise, FIG. 10A is a combination of FIGS. 4A and 7A; FIG. 10B is a combination of FIGS. 4B and 7B; FIG. 10C is a combination of FIGS. 4C and 7C; FIG. 10D is a combination of FIGS. 4D and 7D; FIG. 10E is a combination of FIGS. 4E and 7E; FIG. 10F is a combination of FIGS. 4F and 7F; FIG. 11A is a combination of FIGS. 5A and 8A; FIG. 11B is a combination of FIGS. 5B and 8B; FIG. 11C is a combination of FIGS. 5C and 8C; FIG. 11D is a combination of FIGS. 5D and 8D; FIG. 11E is a combination of FIGS. 5E and 8E; and FIG. 11F is a combination of FIGS. 5F and 8F.

It should be noted that, although the preceding examples have been drawn to raised surface boundaries corresponding to the designated surface route of the taxi clearance, the embodiments herein are not limited to raised surface boundaries. Instead, raised surface centerlines disclosed in the Scherer reference (which includes raised surface transition centerlines that are disclosed in the Scherer reference) may be employed.

In addition to the egocentric, three-dimensional presentations of the raised hold-short lines and/or the single hold-short lines, the embodiments herein are not limited to egocentric representations of scenes located outside the aircraft. Instead, they may be applied to exocentric, three-dimensional representations of a scene located outside the aircraft through the use or employment of techniques known to those skilled in the art.

In addition to the egocentric and exocentric three-dimensional presentations, two-dimensional presentations of surface hold-short lines may be replaced with unconventional markings and presented on the display unit(s). As shown in FIGS. 12A through 18F, an airport comprised of two runway surfaces (i.e., four runways) and two taxiway surfaces are presented on an airport surface map. Although the following discussion will be drawn to the two runway surfaces and the two taxiway surfaces, the disclosures presented herein may be applied to any airport having more or less surfaces. The two runway surfaces are Runways 14/32 (item 230) and Runways 7/25 (item 232), and the two taxiway surfaces are Taxiway A 234 and Taxiway B 236; the directions of Runways 14/32 are 140 degrees and 320 degrees, and the directions of Runways 7/25 are 070 degrees and 250 degrees. Taxiway A is parallel to Runways 14/32, and Taxiway B is parallel to Runways 7/25. Ownship 238 is located on Taxiway A and taxiing in a direction of 320 degrees (the same direction as Runway 32) towards the intersection of the two taxiways; that is, the ground track of ownship 238 is 320 degrees. Referring to FIGS. 12A through 12F, eight sets of conventional surface hold-short lines are presented.

Referring to FIGS. 13A through 13F, the eight sets of conventional surface hold-short lines have been replaced by eight hold-short indicators comprised of hold-short signs. As illustrated, each surface hold-short sign is comprised of a two-dimensional geometric shape, i.e., a stop sign. As embodied herein, the stop sign could be presented in red and/or with text. As embodied herein, hold-short indictors may be presented with various levels of transparency.

Figure 14A:
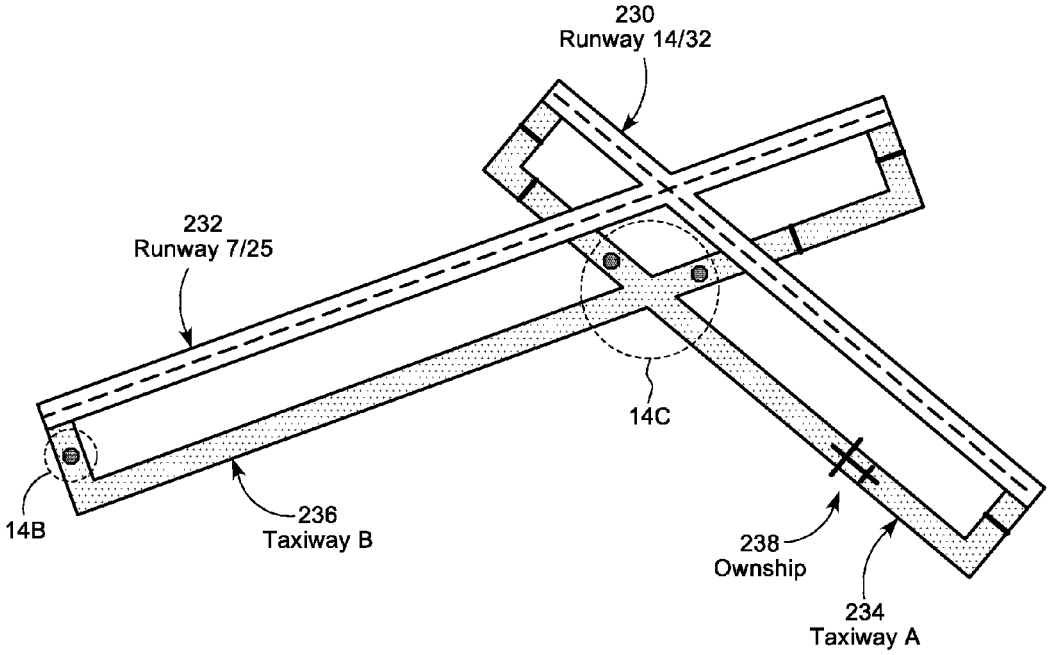
FIG. 14A illustrates an image of an ASM with a plurality of sets of conventional surface hold-short lines and a plurality of unconventional surface hold-short indicators.
Figure 14B:
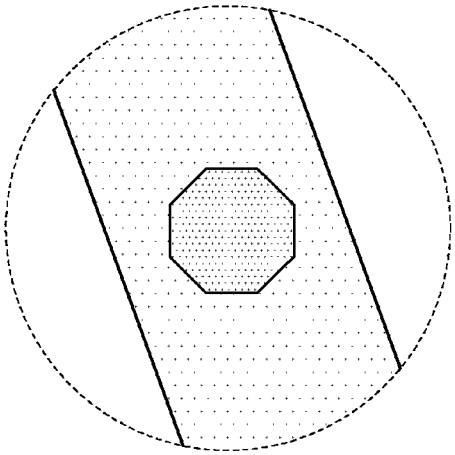
FIG. 14B illustrates one unconventional surface hold-short indicator depicted within the image of the ASM of FIG. 14A.
Figure 14C:
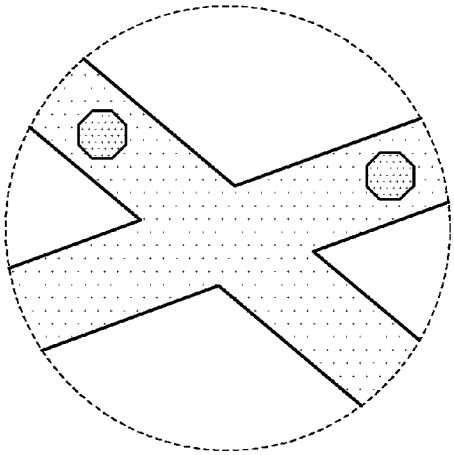
FIG. 14C illustrates two unconventional surface hold-short indicators depicted within the image of the ASM of FIG. 14A.
Figure 14D:
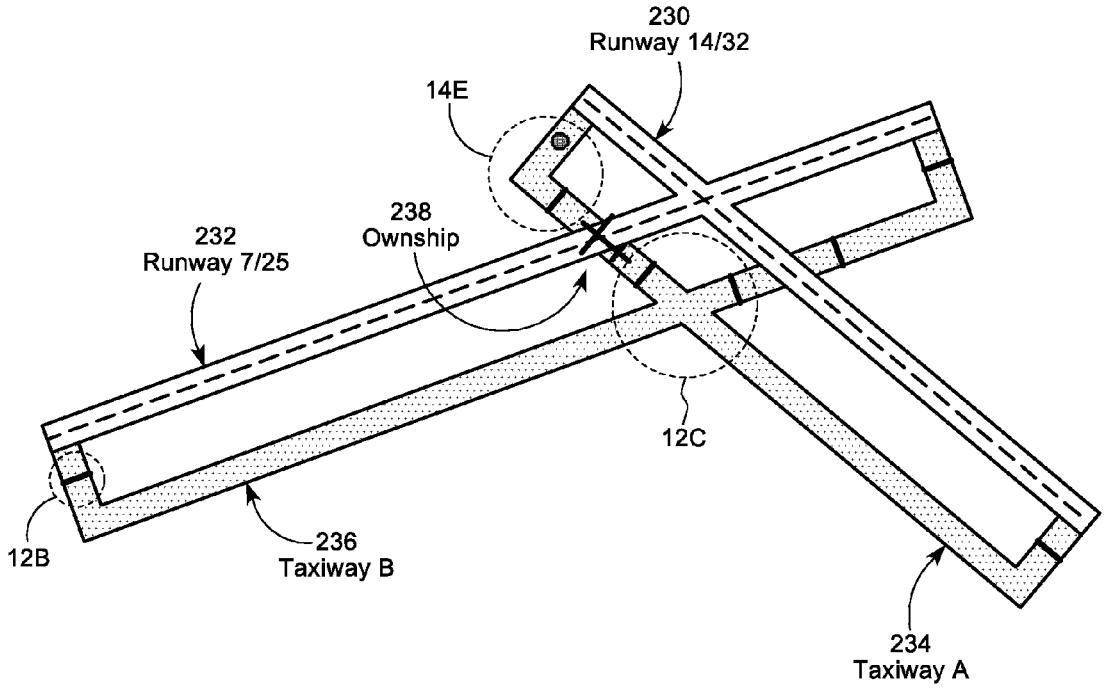
FIG. 14D illustrates an image of an ASM with a plurality of sets of conventional surface hold-short lines and a plurality of unconventional surface hold-short indicators.
Figure 14E:
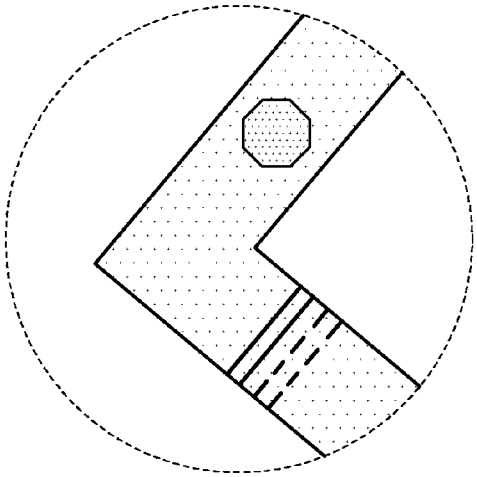
FIG. 14E illustrates one set of conventional surface hold-short lines and one unconventional surface hold-short indicator depicted within the image of the ASM of FIG. 14D.
Figure 15A:
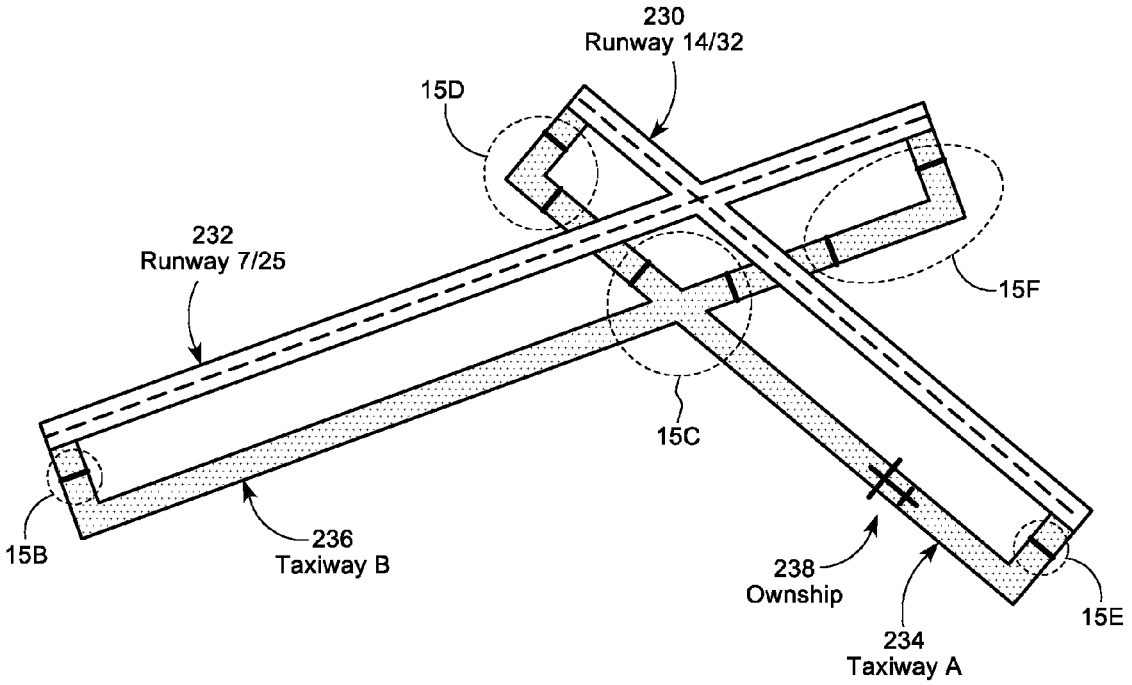
FIG. 15A illustrates an image of an ASM with a plurality of unconventional surface hold-short indicators.
Figure 15B:
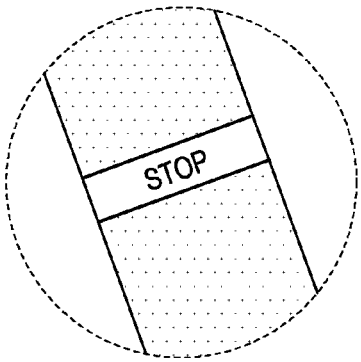
FIG. 15B illustrates one unconventional surface hold-short indicator depicted within the image of the ASM of FIG. 15A.
Figure 15C:
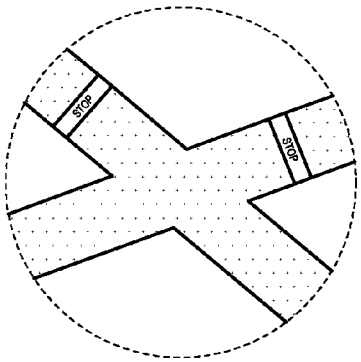
FIG. 15C illustrates two unconventional surface hold-short indicators depicted within the image of the ASM of FIG. 15A.
Figure 15D:
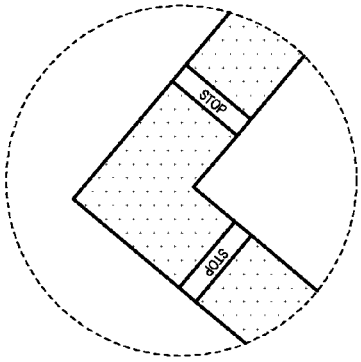
FIG. 15D illustrates two unconventional surface hold-short indicators depicted within the image of the ASM of FIG. 15A.
Figure 15E:
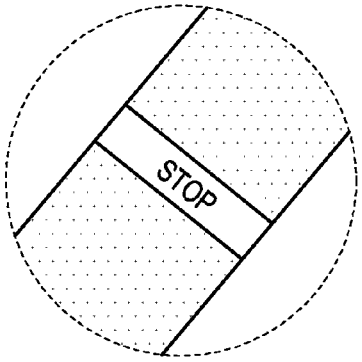
FIG. 15E illustrates one unconventional surface hold-short indicator depicted within the image of the ASM of FIG. 15A.
Figure 15F:
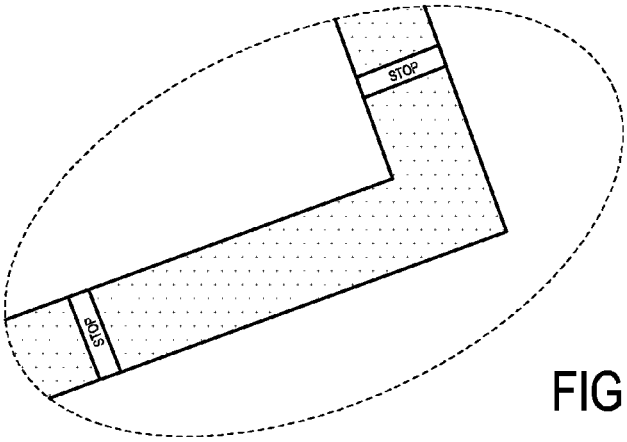
FIG. 15F illustrates two unconventional surface hold-short indicators depicted within the image of the ASM of FIG. 15A.

Although all of the sets of conventional surface hold-short lines in FIGS. 13A through 13F have been replaced with surface hold-short signs, the number of replacements could be limited. For instance, each immediate set(s) of conventional surface hold-short lines that ownship could encounter next could be replaced. Referring to FIGS. 14A through 14C, there are three immediate sets of surface hold-short lines that ownship 238 could encounter next as ownship 238 continues its taxi, and each of them have been replaced with a surface hold-short indicator. Referring to FIGS. 14D and 14E, there is one immediate set of surface hold-short lines that ownship 238 could encounter next as ownship 238 continues its taxi, and it has been replaced with a surface hold-short indicator.

It should be noted that those skilled in the art understand that conventional surface hold-short lines are directional and apply to one direction of taxi. As shown in FIGS. 14D and 14E, the set of surface hold-short lines adjacent to Runway 7/25 are not applicable to ownship 238 in the direction of taxi. As such, this set may not be considered immediate set of conventional surface hold-short lines that ownship 238 could encounter next as ownship 238 continues its taxi.

In another embodiment, each surface hold-short indicator could be comprised of a two-dimensional representation of the single hold-short line discussed in detail above. Referring to FIGS. 15A through 15F, eight single hold-short lines have replaced the eight sets of conventional surface hold-short lines of FIGS. 12A through 12F. As embodied herein, the single hold-short line could be presented in red and/or without text.

Figure 16A:
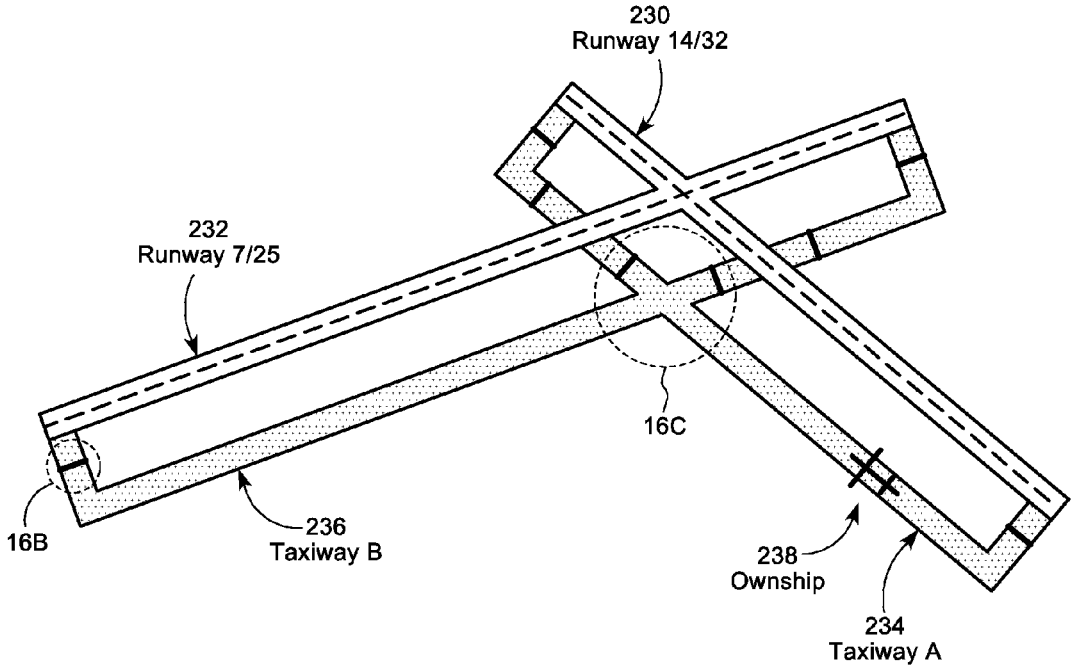
FIG. 16A illustrates an image of an ASM with a plurality of sets of conventional surface hold-short lines and a plurality of unconventional surface hold-short indicators.
Figure 16B:
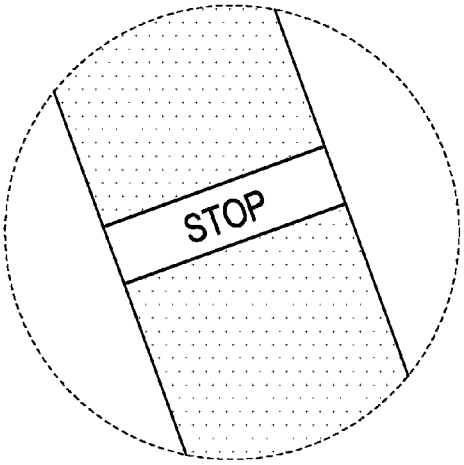
FIG. 16B illustrates one unconventional surface hold-short indicator depicted within the image of the ASM of FIG. 16A.
Figure 16C:
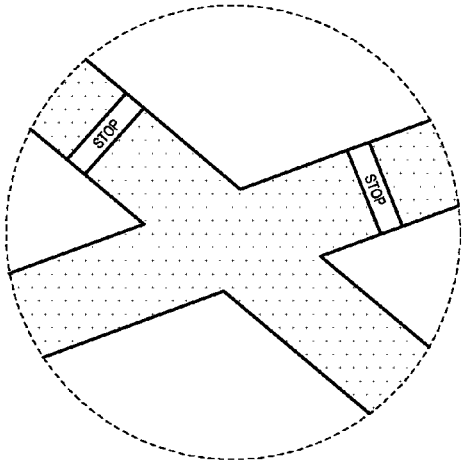
FIG. 16C illustrates two unconventional surface hold-short indicators depicted within the image of the ASM of FIG. 16A.
Figure 16D:
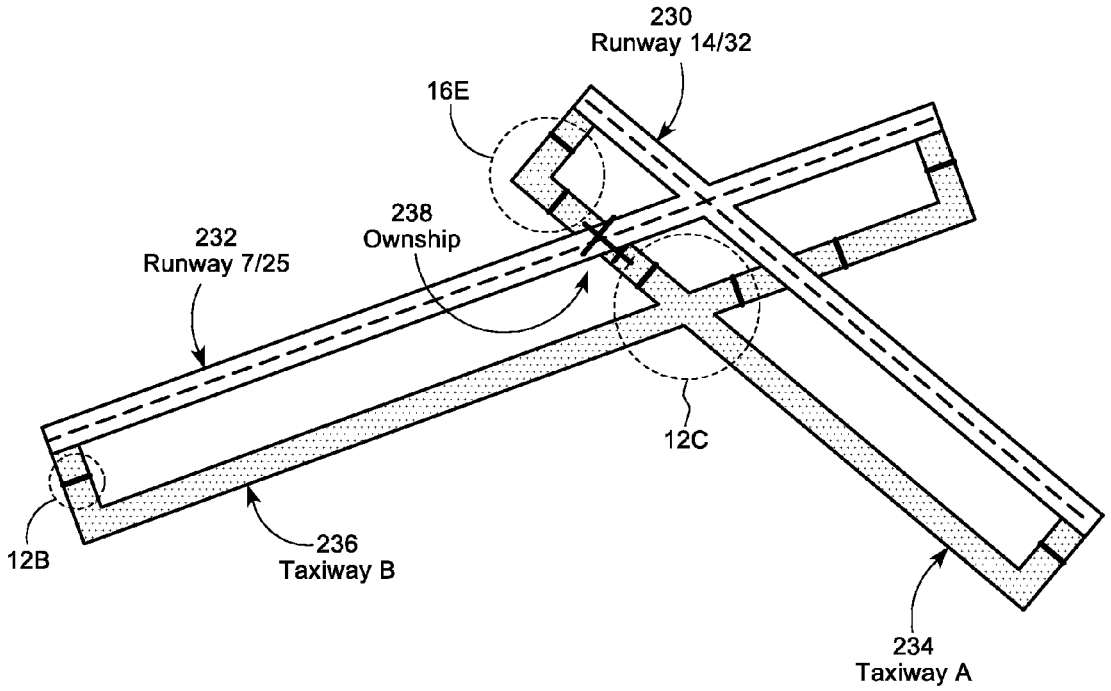
FIG. 16D illustrates an image of an ASM with a plurality of sets of conventional surface hold-short lines and a plurality of unconventional surface hold-short indicators.
Figure 16E:
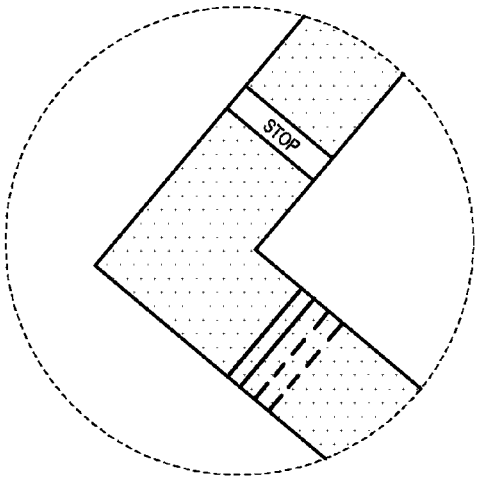
FIG. 16E illustrates one set of conventional surface hold-short lines and one unconventional surface hold-short indicator depicted within the image of the ASM of FIG. 16D.

As discussed above, the number of replacements made to the sets of conventional surface hold-short lines could be limited. Referring to FIGS. 16A through 16C, there are three immediate sets of surface hold-short lines that ownship 238 could encounter next as ownship 238 continues its taxi, and each of them have been replaced with a single hold-short line. Referring to FIGS. 16D and 16E, there is one immediate set of surface hold-short lines that ownship 238 could encounter next as ownship 238 continues its taxi.

Figure 17A:
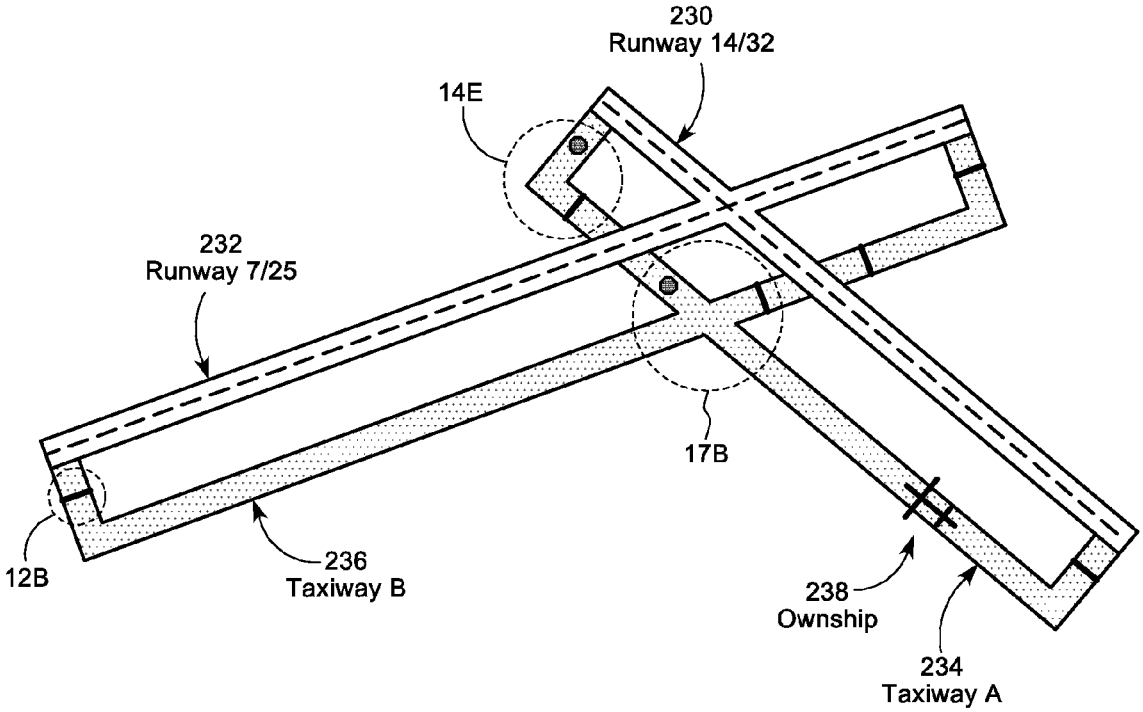
FIG. 17A illustrates an image of an ASM with a plurality of sets of conventional surface hold-short lines and a plurality of unconventional surface hold-short indicators.
Figure 17B:
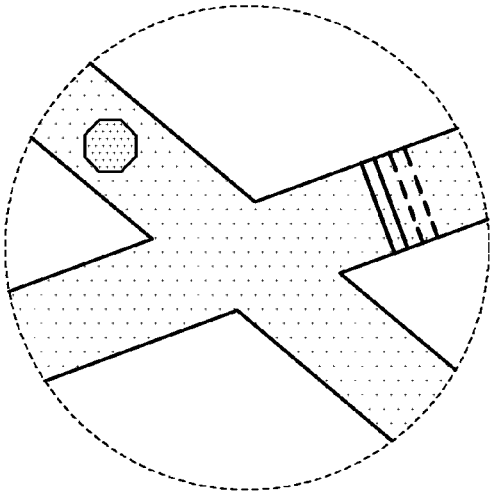
FIG. 17B illustrates one set of conventional surface hold-short lines and one unconventional surface hold-short indicator depicted within the image of the ASM of FIG. 17A.

Referring to FIGS. 17A through 17F, it will be assumed that taxi data has been provided to the processor 140 and that the taxi clearance includes clearance to Runway 14 via Taxiway A and an instruction to "hold-short" of Runway 7/25. As illustrated in FIG. 17A, two sets of surface hold-short lines have been replaced with surface hold-short signs. The surface hold-short sign corresponding to the "hold-short" instruction is shown in FIG. 17B. Because the clearance does not include an instruction to enter onto Runway 14, the surface hold-short sign has replaced the set of surface hold-short lines as adjacent to Runway 14 as shown in FIG. 14E.

Figure 17C:
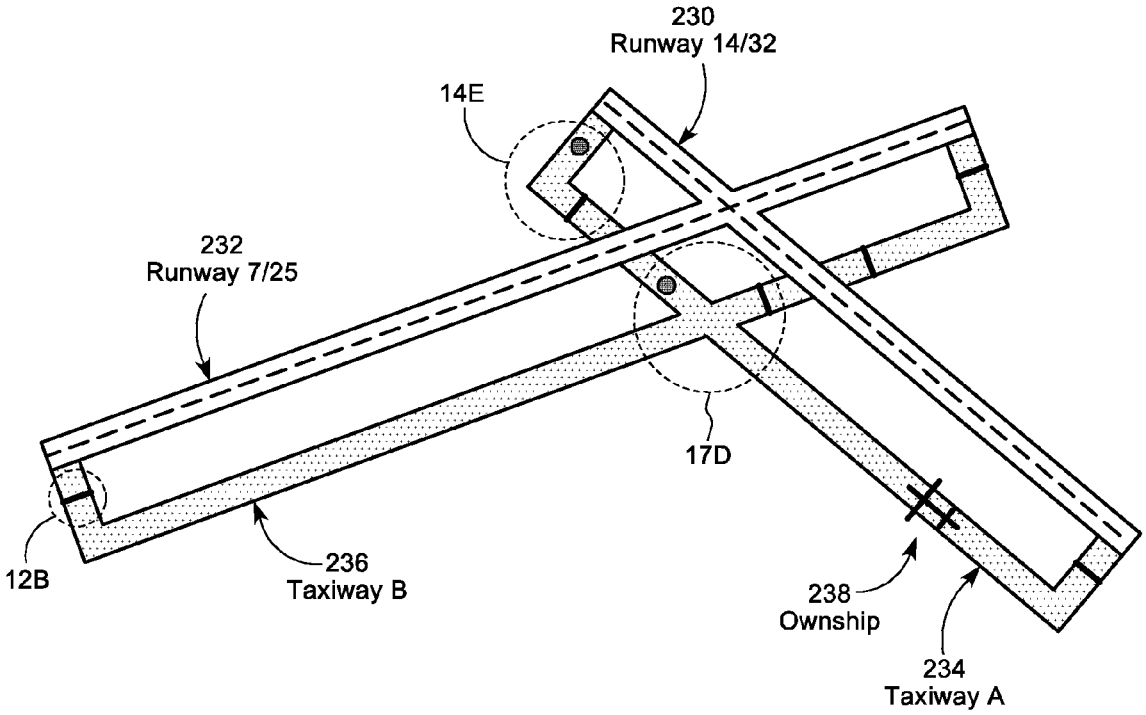
FIG. 17C illustrates an image of an ASM with a plurality of sets of conventional surface hold-short lines and a plurality of unconventional surface hold-short indicators.
Figure 17D:
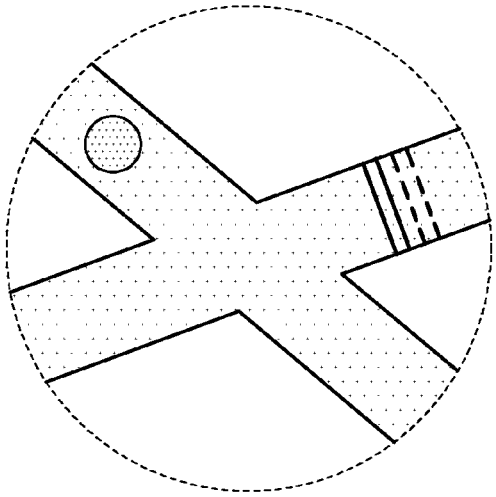
FIG. 17D illustrates one set of conventional surface hold-short lines and one unconventional surface hold-short indicator depicted within the image of the ASM of FIG. 17C.
Figure 17E:
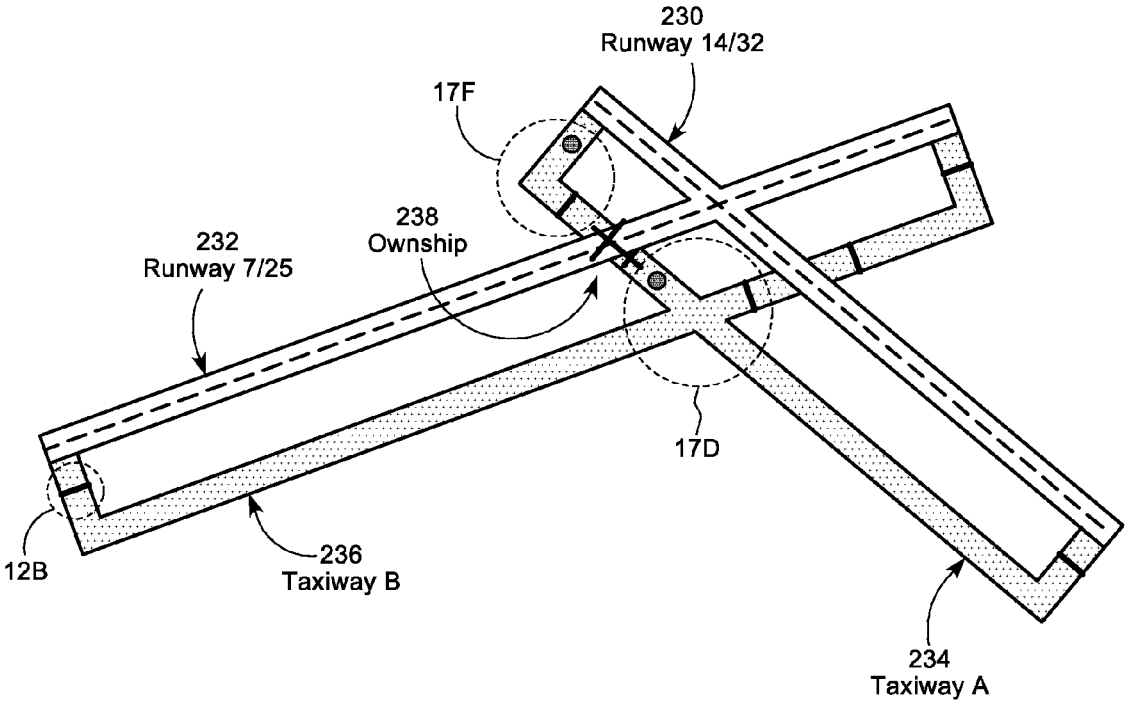
FIG. 17E illustrates an image of an ASM with a plurality of sets of conventional surface hold-short lines and a plurality of unconventional surface hold-short indicators.
Figure 17F:
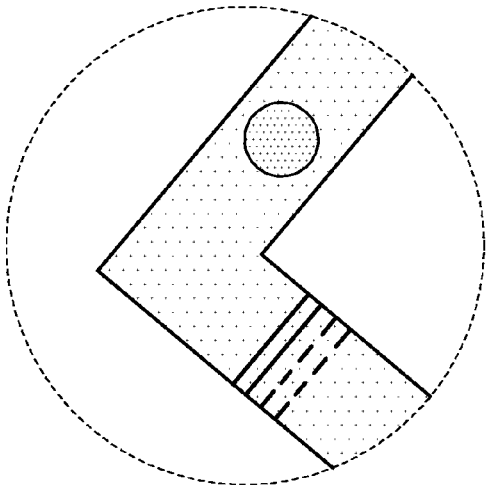
FIG. 17F illustrates one set of conventional surface hold-short lines and one unconventional surface hold-short indicator depicted within the image of the ASM of FIG. 17E.

When a "cross" Runway 7/25 instruction is received, a surface hold-short indicator comprised of a "go" light replaces the surface hold-short sign as shown in FIGS. 17C and 17D. As embodied herein, the "go" light could be presented in green and/or with text. When ownship is cleared onto Runway 14, the surface hold-short light replaces the surface hold-short sign as shown in FIGS. 17E and 17F.

Figure 18A:
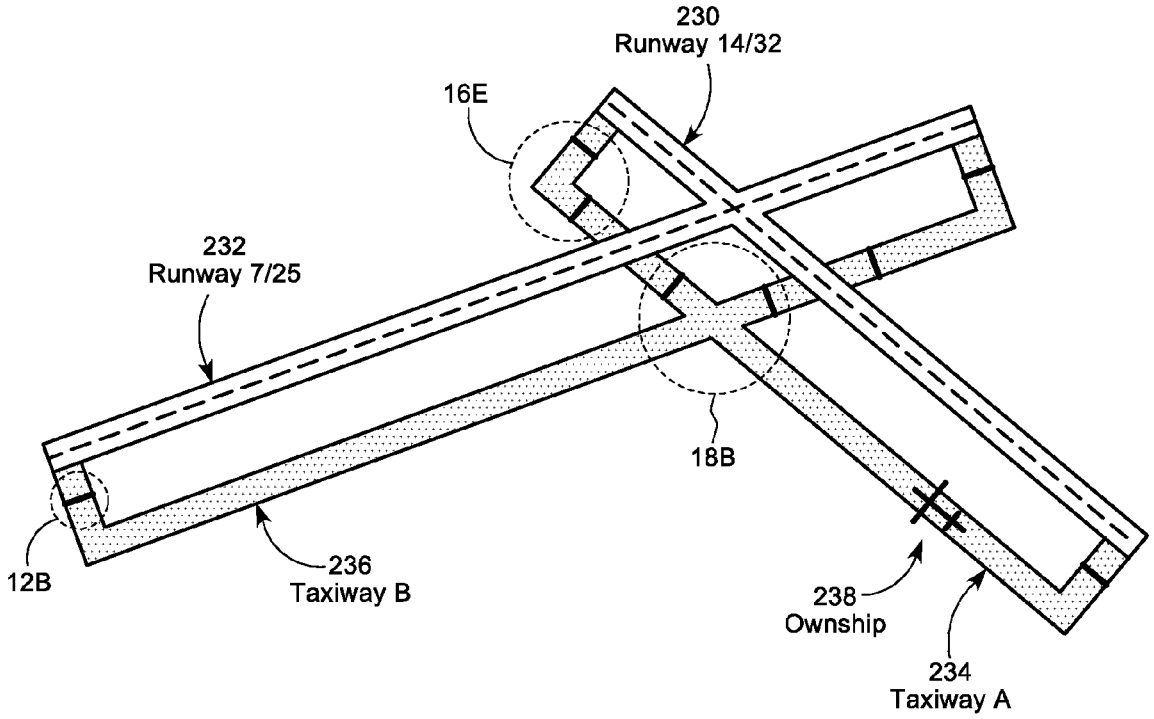
FIG. 18A illustrates an image of an ASM with a plurality of sets of conventional surface hold-short lines and a plurality of unconventional surface hold-short indicators.
Figure 18B:
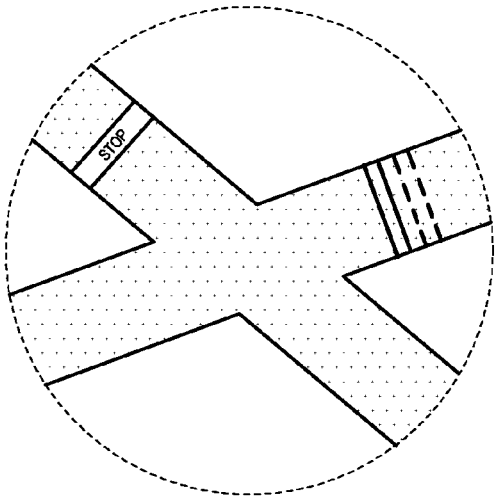
FIG. 18B illustrates one set of conventional surface hold-short lines and one unconventional surface hold-short indicator depicted within the image of the ASM of FIG. 18A.

Referring to FIGS. 18A through 18F, it will be assumed that taxi data has been provided to the processor 140 and that the taxi clearance includes the same clearance as stated above: ownship 238 is cleared to Runway 14 via Taxiway A and an instruction to "hold-short" of Runway 7/25. As illustrated in FIG. 18A, two sets of surface hold-short lines have been replaced with single hold-short lines corresponding to "stop" lines. The single hold-short line corresponding to the "hold-short" instruction is shown in FIG. 18B. Because the clearance does not include an instruction to enter onto Runway 14, the single hold-short line has replaced the set of surface hold-short lines as adjacent to Runway 14 as shown in FIG. 16E.

Figure 18C:
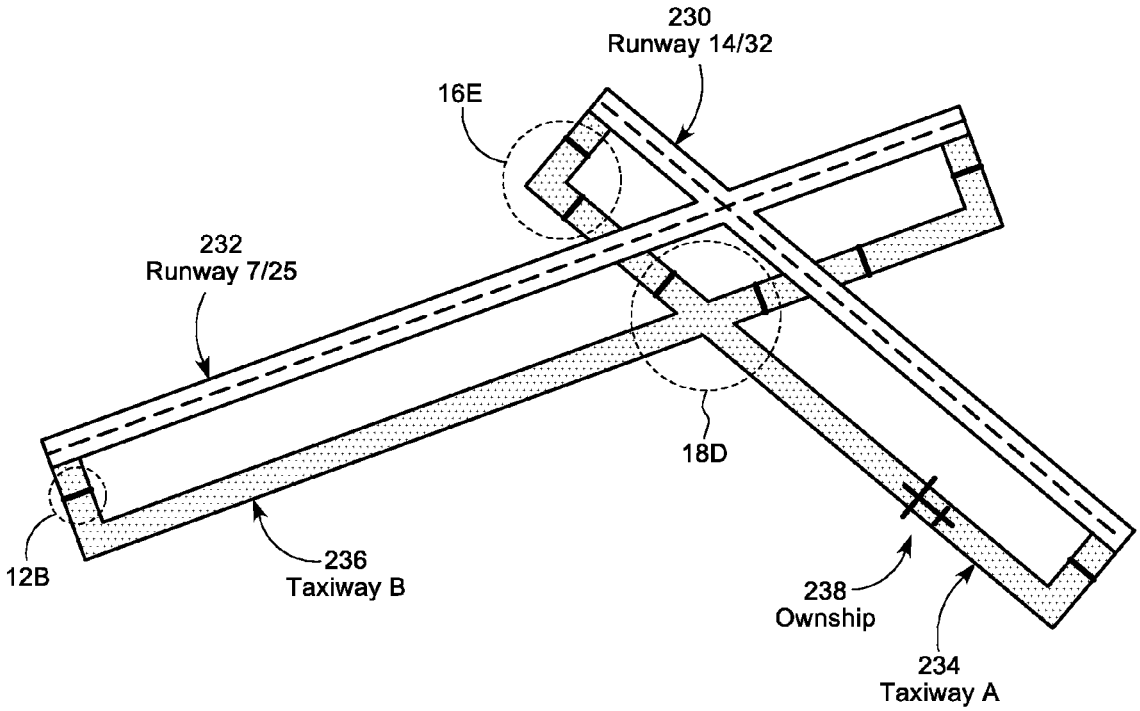
FIG. 18C illustrates an image of an ASM with a plurality of sets of conventional surface hold-short lines and a plurality of unconventional surface hold-short indicators.
Figure 18D:
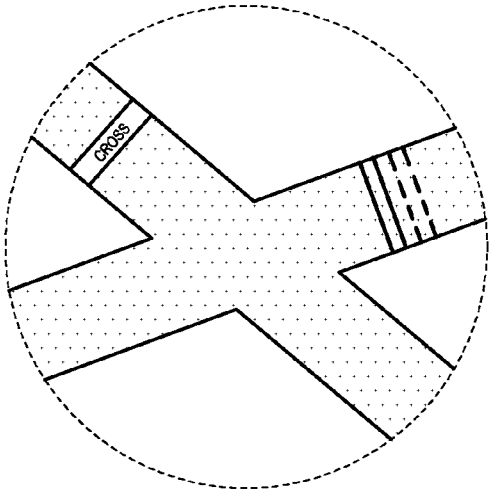
FIG. 18D illustrates one set of conventional surface hold-short lines and one unconventional surface hold-short indicator depicted within the image of the ASM of FIG. 18C.
Figure 18E:
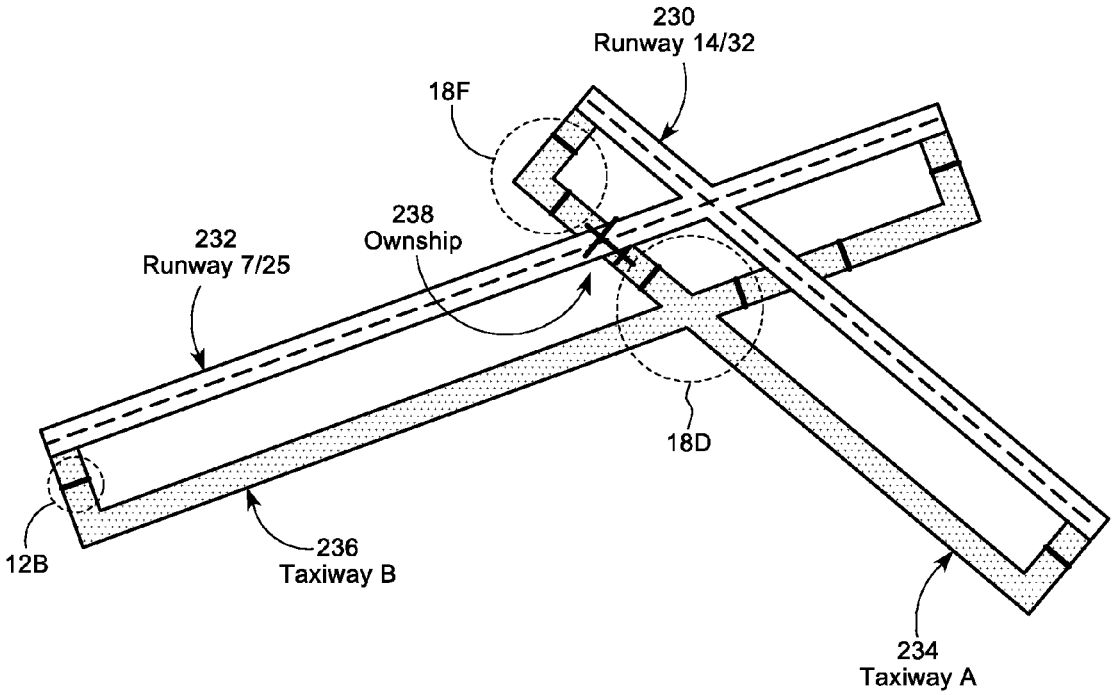
FIG. 18E illustrates an image of an ASM with a plurality of sets of conventional surface hold-short lines and a plurality of unconventional surface hold-short indicators.
Figure 18F:
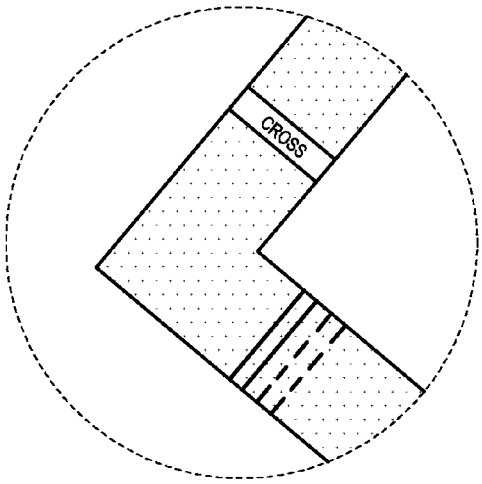
FIG. 18F illustrates one set of conventional surface hold-short lines and one unconventional surface hold-short indicator depicted within the image of the ASM of FIG. 18E.

When a "cross" Runway 7/25 instruction is received, a hold-short indicator comprised of a "cross" line replaces the single hold-short line of a "stop" line as shown in FIGS. 18C and 18D. As embodied herein, this single hold-short line could be presented in green and/or without text. When ownship is cleared onto Runway 14, the surface hold-short line of a "cross" line replaces the surface hold-short line of a "stop" line as shown in FIGS. 18E and 18F.

It should be noted that taxi data representative of a taxi clearance comprised of designated surface(s) and hold short/cross instruction(s) may be provided to the processor 140 automatically via at least a datalink and/or manually via a pilot input device, where the datalink could be comprised of any device(s) which facilitates wireless communications between the aircraft and one or more units (which could include satellites) and/or facilities external to the aircraft. As disclosed by Shapiro et al in U.S. patent application Ser. No. 13/245,898 entitled "System and Method for Electronically Recording a Taxi Clearance of an Aircraft Display Unit" ("the Shapiro reference") and incorporated herein by reference in its entirety, a pilot input device may be employed to facilitated the entry of taxi instructions represented in taxi data.

As disclosed in the Shapiro reference, the pilot input device could comprise any source for facilitating a pilot's interaction with graphical user interfaces ("GUI") referred to as interactive widgets that are displayed on the surface of a local display unit (some non-interactive widgets could also be displayed). As embodied herein, GUIs could include, but not be limited to, location highlighter(s), conventional surface feature(s), and/or unconventional surface feature(s) that are responsive to a pilot's selection. For example, a pilot's selection of a conventional surface feature GUI could enable the presentation of location highlighter. Moreover, where a GUI corresponds to a hold-short or cross instruction, the pilot's selection of one could result with the presentation of the other.

The pilot input device may include any device that allows for the manual selection of a widgets and/or entry of data. Such devices could include, but are not limited to, a tactile device (e.g., keyboard, control display unit, cursor control device, stylus, electronic grease pen, handheld device, touch screen device, notebook, tablet, electronic flight bag, etc. . . . ) and/or speech recognition systems. The pilot input device could be integrated with the display unit if it is configured to receive pilot input (e.g., handheld device, touch screen device, notebook, tablet, etc. . . . ). As embodied herein, the pilot input device may provide input representative of a pilot's selection to the processor 140.

Figure 19:
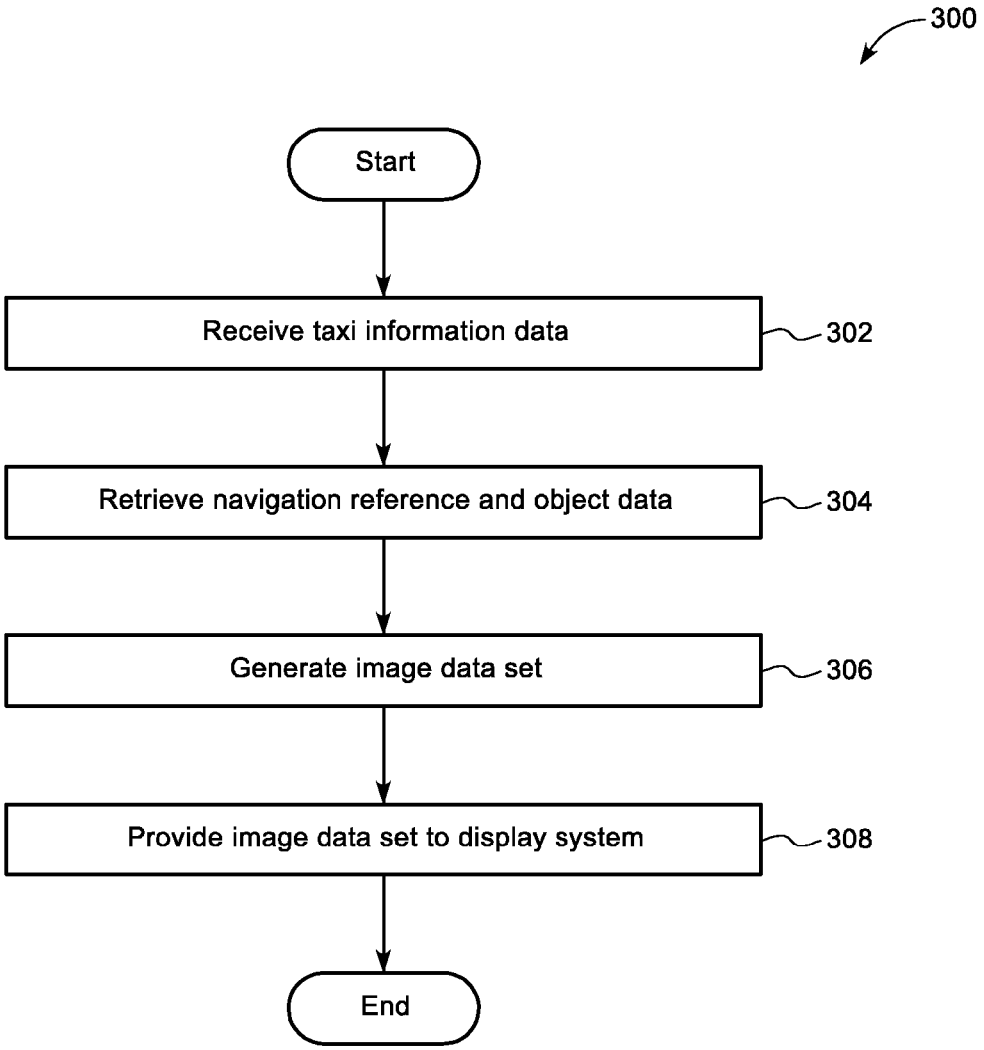
FIG. 19 provides a flowchart illustrating a method for presenting surface information on an aircraft display unit.

FIG. 19 depicts flowchart 300 disclosing an example of a method for presenting taxi information to the pilot of an aircraft, where the processor 140 may be programmed or configured with instructions corresponding to the following modules embodied in flowchart 300. As embodied herein, the processor 140 may be a processor or a combination of processors found in the navigation data source 110, the object data source 120, the reference data source 130, and/or the display system 150. Also, the processor 140 may be a processor of a module such as, but not limited to, a printed circuit card having one or more input interfaces to facilitate the two-way data communications of the processor 140, i.e., the receiving and providing of data. As necessary for the accomplishment of the following modules embodied in flowchart 300, the receiving of data is synonymous and/or interchangeable with the retrieving of data, and the providing of data is synonymous and/or interchangeable with the making available or supplying of data.

The flowchart 300 begins with module 302 with the retrieving of aircraft taxi information data. Here, the taxi information data may be representative of at least the current location of the aircraft, from which taxi direction may be determined through the use of subsequent position information. In an additional embodiment, taxi information data may include data representative of a taxi clearance designating surface information and/or "hold short" or "cross" instructions if such instructions have been provided.

The flowchart continues with module 304 with the retrieving of navigation reference and object data. Here, the retrieval of the navigation reference and object data could be representative of one or more surfaces corresponding to the current position of the aircraft. In one embodiment, navigation reference and object data could include location data representative of a plurality of locations of surface features and/or raised surface features. For the purpose of illustration and not of limitation, surface features could be comprised of conventional surface hold-short lines and/or unconventional surface hold-short indicators, and raised surface features could be comprised of raised hold-short lines. In an embodiment in which a taxi clearance is received, surface features could be comprised of one or more surface edges or boundaries and/or one or more surface centerlines corresponding to the designated surface information.

The flowchart continues to module 306 with the generation of a first image data set, a second image data set, or a third image data set, where each image data set could be generated as a function of at least the aircraft taxi information data and the navigation reference and object data.

The first image data set could be representative of an image within which one or more location highlighters and one or more surfaces appear within an egocentric or exocentric three-dimensional representation of a scene located outside the aircraft. In an embodiment in which a surface feature is comprised of surface hold-short lines, each location highlighter may highlight the location of raised surface hold-short lines above and/or to the side of the location of surface hold-short lines; surface hold-short lines may be depicted as conventional surface hold-short lines, unconventional surface hold-short indicator(s) such as a single hold-short line, or both. As embodied herein, each location highlighter may be comprised of a geometric shape and/or text; also, if a taxi clearance has been received, the geometric shape and/or text of each location highlighter may correspond to the current instruction (e.g., "hold-short" or "cross") applicable to the hold-short lines. Also, location highlighter(s) may be presented with various levels of transparency.

If a taxi clearance is received, the location highlighter(s) highlighting the location of raised surface hold-short lines could be limited to designated surface(s). Additionally, location highlighters could include those highlighting one or more raised surface boundaries comprised of locations above the surface boundaries and/or one or more raised surface centerlines comprised of locations above the surface centerlines.

In an additional embodiment, the image could include one or more unconventional surface hold-short indicators, where one unconventional surface hold-short indicator may replace one set of conventional surface hold-short lines. As embodied herein, each unconventional surface hold-short indicator may be comprised of a single hold-short line which may include text. If a taxi clearance is received, the single hold-short line(s) could be limited to designated surface(s); also, if a single hold-short line includes text, the text of each may correspond to the current instruction applicable to the hold-short lines when a taxi clearance has been received. In addition, unconventional surface hold-short indicator(s) may be presented with various levels of transparency.

The second image data set could be representative of an image within which one or more unconventional surface hold-short indicators and one or more surfaces appear within an egocentric or exocentric three-dimensional representation of a scene located outside the aircraft. One unconventional surface hold-short indicator may replace one set of conventional surface hold-short lines. If a taxi clearance is received, the unconventional surface hold-short indicator(s) could be limited to designated surface(s).

Additionally, the image could include one or more location highlighters. In one embodiment, location highlighter(s) could include those highlighting location of raised surface hold-short lines comprised of a location above and/or to the side of the hold-short lines. If a taxi clearance is received, the location highlighter(s) highlighting the location of raised surface hold-short lines could be limited to designated surface(s). Additionally, location highlighters could include those highlighting one or more raised surface boundaries comprised of locations above the surface boundaries and/or one or more raised surface centerlines comprised of locations above the surface centerlines.

The third image data set could be representative of an image within which one or more unconventional hold-short indicators and one or more surfaces appear within an airport surface map. Each unconventional hold-short indicator may replace a set of conventional surface hold-short lines. As embodied herein, each unconventional hold-short indicator may be comprised of a geometric shape and/or text. If a taxi clearance is received, the geometric shape and/or text of each hold-short indicator may correspond to the current instruction applicable to the hold-short lines.

The flowchart continues to module 308 with the providing of an image data set to a display system, wherein the image represented in the image data set may be presented on one or more display units. If the image data set is a first image data set, one or more location highlighters may appear as being superimposed against a three-dimensional representation of a scene located outside the aircraft; as embodied herein, the representation may be presented egocentrically or exocentrically. If the image data set is a second image data set, one or more unconventional surface hold-short indicators may appear within an egocentric or exocentric three-dimensional representation of a scene located outside the aircraft. If the image data set is a third image data set, one or more unconventional hold-short indicators may appear as being superimposed against an airport surface map. Then, the flowchart proceeds to the end.

It should be noted that the method steps described above may be embodied in computer-readable media as computer instruction code. It shall be appreciated to those skilled in the art that not all method steps described must be performed, nor must they be performed in the order stated.

As used herein, the term "embodiment" means an embodiment that serves to illustrate by way of example but not limitation.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. A method for presenting surface information to a pilot of an aircraft, such system comprising:

receiving taxi information data representative of at least the current position of an aircraft;

retrieving navigation reference and object data representative of at least one surface feature corresponding to the taxi information data;

generating an image data set as a function of the taxi information data and the navigation reference and object data, where the image data set is representative of an image in which at least one first location highlighter highlighting the location of at least one first raised surface feature is depicted within a three-dimensional representation of a scene located outside the aircraft, where each first raised surface feature appears above the location of one first surface feature; and providing the image data set to a display system, whereby at least one location highlighter appears superimposed against the perspective scene outside the aircraft.

2. The method of claim 1, wherein one first raised surface feature is comprised of one raised hold-short line, where each first raised hold-short line is comprised of a geometric shape, text, or both.

3. The method of claim 2, wherein the taxi information data is further representative of a taxi clearance comprised of at least one hold short/cross instruction, such that each hold short/cross instruction is indicated by one raised hold-short line.

4. The method of claim 2, wherein at least one location of one first surface feature is depicted as a set of conventional surface hold-short lines, or an unconventional surface hold-short indicator.

5. The method of claim 4, wherein the taxi information data is further representative of a taxi clearance comprised of at least one hold short/cross instruction, such that each hold short/cross instruction is indicated by one unconventional surface hold-short indicator.

6. The method of claim 1, wherein the navigation reference and object data includes data representative of at least one raised surface feature.

7. The method of claim 1, wherein the taxi information data is further representative of a taxi clearance comprised of at least one designated surface, such that the image further includes at least one second location highlighter highlighting the location of at least one second raised surface feature and depicted within the three-dimensional representation, where each second raised surface feature corresponds to one designated surface, and appears above one second surface feature, where one second raised surface feature is comprised of one raised surface boundary, and one second surface feature is comprised of one surface boundary.

8. The method of claim 1, wherein the taxi information data is further representative of a taxi clearance comprised of at least one designated surface, such that the image further includes at least one third location highlighter highlighting the location of at least one third raised surface feature corresponding to one designated surface and depicted within the three-dimensional representation, where each third raised surface feature corresponds to one designated surface, and appears above one third surface feature, where one third raised surface feature is comprised of one raised surface centerline, and one third surface feature is comprised of one surface centerline.

9. A method for presenting surface information to a pilot of an aircraft, such system comprising:

receiving taxi information data representative of at least the current position of an aircraft;

retrieving navigation reference and object data representative of at least one surface feature corresponding to the taxi information data;

generating an image data set as a function of the taxi information data and the navigation reference and object data, where the image data set is representative of an image in which at least one unconventional surface feature is depicted within a three-dimensional representation of a scene located outside the aircraft, where each unconventional surface feature appears at the location of one conventional surface feature; and providing the image data set to a display system, whereby at least one unconventional surface feature appears superimposed against the perspective scene outside the aircraft.

10. The method of claim 9, wherein one unconventional surface feature is comprised of one unconventional surface hold-short indicator, where each unconventional surface hold-short indicator is comprised of a geometric shape, text, or both.

11. The method of claim 10, wherein the taxi information data is further representative of a taxi clearance comprised of at least one hold short/cross instruction, such that each hold short/cross instruction is indicated by one unconventional surface hold-short indicator.

12. The method of claim 10, wherein the image further includes at least one first location highlighter highlighting the location of at least one raised hold-short line and depicted within the three-dimensional representation, where each raised hold-short line appears above one unconventional surface hold-short indicator.

13. The method of claim 12, wherein the taxi information data is further representative of a taxi clearance comprised of at least one hold short/cross instruction, such that each hold short/cross instruction is indicated by one raised hold-short line.

14. The method of claim 9, wherein the navigation reference and object data includes data representative of at least one unconventional surface feature.

15. The method of claim 9, wherein the taxi information data is further representative of a taxi clearance comprised of at least one designated surface, such that the image further includes at least one second location highlighter highlighting the location of at least one raised surface boundary and depicted within the three-dimensional representation, where each raised surface boundary corresponds to one designated surface, and appears above the location of one surface boundary.

16. The method of claim 9, wherein the taxi information data is further representative of a taxi clearance comprised of at least one designated surface, such that the image further includes at least one third location highlighter highlighting the location of at least one raised surface centerline and depicted within the three-dimensional representation, where each raised surface centerline corresponds to one designated surface, and appears above the location of one surface centerline.

17. A method for presenting surface information to a pilot of an aircraft, such system comprising:

receiving taxi information data representative of at least the current position of an aircraft;

retrieving navigation reference and object data representative of at least one surface feature corresponding to the taxi information data;

generating an image data set as a function of the taxi information data and the navigation reference and object data, where the image data set is representative of an image in which at least one unconventional surface feature is depicted within an airport surface map, where each unconventional surface feature appears at the location of one conventional surface feature; and providing the image data set to a display system, whereby at least one unconventional surface feature appears superimposed against the airport surface map.

18. The method of claim 17, wherein one unconventional surface feature is comprised of one unconventional surface hold-short indicator, where each unconventional surface hold-short indicator is comprised of a geometric shape, text, or both.

19. The method of claim 18, wherein the taxi information data is further representative of a taxi clearance comprised of at least one hold short/cross instruction, such that each hold short/cross instruction is indicated by one unconventional surface hold-short indicator.

20. The method of claim 17, wherein the navigation reference and object data includes data representative of at least one unconventional surface feature.

* * * * *